US009240647B2

(12) United States Patent
Isoda

(10) Patent No.: US 9,240,647 B2
(45) Date of Patent: Jan. 19, 2016

(54) CONNECTOR AND MATING CONNECTOR CONNECTABLE TO THE SAME

(71) Applicant: HOSIDEN CORPORATION, Yao-shi (JP)

(72) Inventor: Masaya Isoda, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 171 days.

(21) Appl. No.: 14/163,050

(22) Filed: Jan. 24, 2014

(65) Prior Publication Data

US 2014/0213114 A1 Jul. 31, 2014

(30) Foreign Application Priority Data

Jan. 28, 2013 (JP) ..... 2013-012936

(51) Int. Cl.

| | |
|---|---|
| ***H01R 24/00*** | (2011.01) |
| ***H01R 13/516*** | (2006.01) |
| ***H01R 11/07*** | (2006.01) |
| ***H01R 24/60*** | (2011.01) |
| *H01R 4/02* | (2006.01) |
| *H01R 12/70* | (2011.01) |

(52) U.S. Cl.

CPC ..... *H01R 13/516* (2013.01); *H01R 11/07* (2013.01); *H01R 24/60* (2013.01); *H01R 4/023* (2013.01); *H01R 12/7088* (2013.01)

(58) Field of Classification Search

CPC ..... H01R 13/516; H01R 4/023; H01R 11/07; H01R 12/7088; H01R 24/60

USPC ..... 439/350, 372, 626, 660

See application file for complete search history.

(56) References Cited

U.S. PATENT DOCUMENTS

| | | | | |
|---|---|---|---|---|
| 6,224,423 | B1 | 5/2001 | Yip et al. | |
| 6,905,367 | B2 * | 6/2005 | Crane, Jr. | H01R 13/514 439/607.01 |
| 7,485,008 | B1 | 2/2009 | Yi | |
| 7,534,143 | B1 | 5/2009 | Tsao et al. | |
| 2015/0214672 | A1 * | 7/2015 | Wu | H01R 4/28 439/579 |

OTHER PUBLICATIONS

Extended European Search Report issued on Mar. 2, 2015 for the counterpart European patent application No. 14250010.7.

* cited by examiner

*Primary Examiner* — Khiem Nguyen

(74) *Attorney, Agent, or Firm* — Kratz, Quintos & Hanson, LLP

(57) ABSTRACT

The invention provides a connector including a body, first, second, third, and fourth terminals, and first and second connection objects. The body includes a first recess including a first bottom and a first side wall, and a second recess including a second bottom and a second side wall. The first terminal includes a first connecting portion provided in or on the first bottom, or with clearance from the first bottom. The second terminal includes a second connecting portion provided in or on the first side wall. The third terminal includes a third connecting portion provided in or on the second bottom, or with clearance from the second bottom. The fourth terminal includes a fourth connecting portion provided in or on the second side wall. The first connection object is connected to the first and second connecting portions. The second connection object is connected to the third and fourth connecting portions.

22 Claims, 19 Drawing Sheets

CONNECTOR AND MATING CONNECTOR CONNECTABLE TO THE SAME

CROSS-REFERENCE TO RELATED APPLICATIONS

The present application claims priority under 35 U.S.C. §119 of Japanese Patent Application No. 2013-012936 filed on Jan. 28, 2013, the disclosure of which is expressly incorporated by reference herein in its entity.

BACKGROUND OF THE INVENTION

1. Technical Field

The present invention relates to connectors and mating connectors connectable to the same.

2. Background Art

U.S. Pat. No. 7,485,008 discloses a conventional connector including a insulating body, a first terminal group, a second terminal group, and a cable.

SUMMARY OF INVENTION

At least one of the first and second terminal groups includes a pair of signal terminals and a pair of power terminals. The signal terminals are used to transmit and receive signals, and the power terminals are used to supply power. The signal terminals and the power terminals are connected to core wires of the cable.

The above connector is demanded to supply power with a pair of or a plurality of pairs of power terminals. In other words, the connector is demanded to supply power in a single electrical system or a plurality of systems. However, the connector with a plurality of pairs of power terminals should require space for connection between the power terminal and the core wire (connection object) of the cable in accordance with the number of the power terminals and the core wires, resulting in the upsizing of the connector.

In view of the above-mentioned circumstances, the invention is devised to provide a connector with reduced space for connection between the terminals and the connection objects.

A first connector of the invention includes a body, first, second, third, and fourth terminals, and first and second connection objects. The body has an insulation property. The body includes a connection part and first and second recesses. The first recess includes a first bottom and a first side wall. The second recess includes a second bottom and a second side wall. The first, second, third, and fourth terminals are held by the body. The first terminal includes a first contact portion and a first connecting portion. The first contact portion is provided at the connection part of the body. The first connecting portion is provided in the first bottom of the body so as to be exposed from the first bottom, or provided on the first bottom, or provided with clearance from the first bottom. The second terminal includes a second contact portion and a second connecting portion. The second contact portion is provided at the connection part of the body. The second connecting portion is provided in the first side wall of the body so as to be exposed from the first side wall, or provided on the first side wall. The third terminal includes a third contact portion and a third connecting portion. The third contact portion is provided at the connection part of the body. The third connecting portion is provided in the second bottom of the body so as to be exposed from the second bottom, or provided on the second bottom, or provided with clearance from the second bottom. The fourth terminal includes a fourth contact portion and a fourth connecting portion. The fourth contact portion is provided at the connection part of the body. The fourth connecting portion is provided in the second side wall of the body so as to be exposed from the second side wall, or provided on the second side wall. The first connection object is connected to the first and second connecting portions in the first recess. The second connection object is connected to the third and fourth connecting portions in the second recess.

In the first connector of this aspect, the first connecting portion is provided at the first bottom of the first recess, and the second connecting portion is provided at the first side wall of the first recess. The first connection object is connected to the first connecting portion and the second connecting portion together in the first recess. The third connecting portion is provided at the second bottom of the second recess, and the fourth connecting portion is provided at the second side wall of the second recess. The second connection object is connected to the third connecting portion and the fourth connecting portion together in the second recess. These arrangements can reduce the connection space for connecting the first connection object to the first and second connecting portions of the first and second terminals, and the connection space for connecting the second connection object to the third and fourth connecting portions of the third and fourth terminals. If the first, second, third, and fourth terminals are used as terminals for power supply, power can be supplied by way of one of the first and second terminals and one of the third and fourth terminals (i.e. power supply in one electrical system), or by way of the first, second, third, and fourth terminals (i.e. power supply in a plurality of electrical systems).

The second connecting portion may include a first portion and a second portion. The first portion of the second connecting portion may be provided in the first side wall of the body so as to be exposed from the first side wall, or provided on the first side wall. The second portion may be contiguous with the first portion and located under and in contact with the first connecting portion. The fourth connecting portion may include a first portion and a second portion. The first portion of the fourth connecting portion may be provided in the second side wall of the body so as to be exposed from the second side wall, or provided on the second side wall. The second portion of the fourth connecting portion may be contiguous with the first portion of the fourth connecting portion and located under and in contact with the third connecting portion.

In the first connector of this aspect, the second connecting portion includes the first and second portions, and the first connecting portion is in physical and electrical contact with the second portion of the second connecting portion. This arrangement can increase the connection area of the first connection object with respect to the first and second connecting portions. Further advantageously, electrical connection is established between the first connection object and both the first and second connecting portions, by connecting the first connection object to at least one of the connecting portions. This arrangement can improve the reliability of connection between the first connection object and the first and second terminals. The fourth connecting portion includes the first and second portions, and the third connecting portion is in physical and electrical contact with the second portion of the fourth connecting portion. This arrangement can increase the connection area of the second connection object with respect to the third and fourth connecting portions. Further advantageously, electrical connection is established between the second connection object and both the third and fourth connecting portions, by connecting the second connection object to at least one of the connecting portions. This arrangement can improve the reliability of connection between the second connection object and the third and fourth terminals.

The first connecting portion may have smaller outer dimensions than the second portion of the second connecting portion. The third connecting portion may have smaller outer dimensions than the second portion of the fourth connecting portion.

In the first connector of this aspect, the second portion of the second connecting portion is partially exposed outside the first connecting portion. The second portion of the fourth connecting portion is partially exposed outside the third connecting portion. These arrangements can increase the area for connection between the first connection object and the first and second connecting portions, and the area for connection between the second connection object and the third and fourth connecting portions. Therefore, it is possible to further improve the reliability of connection between the first connection object and the first and second terminals, and between the second connection object and third and fourth terminals.

Alternatively, the second portion of the second connecting portion may be disposed on top of, not under, and in contact with the first connecting portion. The second portion of the fourth connecting portion may be disposed on top of, not under, and in contact with the third connecting portion.

In the first connector of this aspect, the second connecting portion includes the first and second portions, and the first connecting portion is in physical and electrical contact with the second portion of the second connecting portion. This arrangement can increase the connection area of the first connection object with respect to the first and second connecting portions. Further advantageously, electrical connection is established between the first connection object and both the first and second connecting portions, by connecting the first connection object to at least one of the connecting portions. This arrangement can improve the reliability of connection between the first connection object and the first and second terminals. The fourth connecting portion includes the first and second portions, and the third connecting portion is in physical and electrical contact with the second portion of the fourth connecting portion. This arrangement can increase the connection area of the second connection object with respect to the third and fourth connecting portions. Further advantageously, electrical connection is established between the second connection object and both the third and fourth connecting portions, by connecting the second connection object to at least one of the connecting portions. This arrangement can improve the reliability of connection between the second connection object and the third and fourth terminals.

The second portion of the second connecting portion may have smaller outer dimensions than the first connecting portion. The second portion of the fourth connecting portion may have smaller outer dimensions than the third connecting portion.

In the first connector of this aspect, the first connecting portion is partially exposed outside the second portion of the second connecting portion. The third connecting portion is partially exposed outside the second portion of the fourth connecting portion. These arrangements can increase the area for connection between the first connection object and the first and second connecting portions, and the area for connection between the second connection object and the third and fourth connecting portions. Therefore, it is possible to further improve the reliability of connection between the first connection object and the first and second terminals, and between the second connection object and third and fourth terminals.

A second connector of the invention includes a body, first, second, third, and fourth terminals, and first and second connection objects. The body has an insulation property. The body includes a connection part and first and second recesses. The first recess includes a first bottom and a first side wall. The second recess includes a second bottom and a second side wall. The first, second, third, and fourth terminals are held by the body. The second terminal includes a second contact portion and a second connecting portion. The second contact portion is provided at the connection part of the body. The second connecting portion is provided on the first bottom of the body. The first terminal includes a first contact portion and a first connecting portion. The first contact portion is provided at the connection part of the body. The first connecting portion is provided on the second connecting portion. The fourth terminal includes a fourth contact portion and a fourth connecting portion. The fourth contact portion is provided at the connection part of the body. The fourth connecting portion is provided on the second bottom of the body. The third terminal includes a third contact portion and a third connecting portion. The third contact portion is provided at the connection part of the body. The third connecting portion is provided on the fourth connecting portion. The first connection object is connected to the first and second connecting portions in the first recess. The second connection object is connected to the third and fourth connecting portions in the second recess.

In the second connector of this aspect, the first and second connecting portions are stacked on the first bottom of the first recess. The third and fourth connecting portions are stacked on the first bottom of the second recess. The first connection object is connected to the second and first connecting portions together in the first recess. The second connection object is connected to the fourth and third connecting portions together in the second recess. These arrangements can reduce the connection space for connecting the first connection object to the first and second connecting portions of the first and second terminals, and the connection space for connecting the second connection object to the third and fourth connecting portions of the third and fourth terminals can be reduced. If the first, second, third, and fourth terminals are used as terminals for power supply, power can be supplied by way of one of the first and second terminals and one of the third and fourth terminals (i.e. power supply in one electrical system), or by way of the first, second, third, and fourth terminals (i.e. power supply in a plurality of electrical systems).

The first and second connecting portions may be integral with each other. The third and fourth connecting portions may be integral with each other. The first and second connectors of this aspect can be manufactured with a reduced number of components.

The first and second connector may each further include a cable. The cable may include a first core wire serving as the first connection object and a second core wire serving as the second connection object.

The first and second contact portions may be provided at the connection part so as to be at least partially exposed from different places of the connection part. The third and fourth contact portions may be provided at the connection part so as to be at least partially exposed from different places of the connection part.

A first mating connector of the invention is connectable with the first and second connectors according to any of above aspects. The first mating connector includes a body, a signal terminal, and first, second, third, and fourth power terminal. The body has an insulation property. The signal terminal is held by the body of the mating connector. The first power terminal is held by the body of the mating connector so as to be contactable with the third contact portion of the third terminal. The second power terminal is held by the body of the mating connector so as to be contactable with the fourth contact portion of the fourth terminal. The third power terminal is held by the body of the mating connector so as to be contactable with the first contact portion of the first terminal. The fourth power terminal is held by the body of the mating connector so as to be contactable with the second contact portion of the second terminal.

The first mating connector of this aspect is applicable to power supply through a plurality of electrical systems, by bringing the first power terminal into contact with the third contact portion of the third terminal, the second power terminal into contact with the fourth contact portion of the fourth terminal, the third power terminal into contact with the first contact portion of the first terminal, and the fourth power terminal into contact with the second contact portion of the second terminal. The first mating connector can perform signal transmission also with another type of connector, by bringing the signal terminal into contact with a terminal of the another type of connector.

The body may include a base and first and second protruding parts. The first protruding part is provided on the base. The second protruding part may be provided on the first protruding part. The first, second, third, and fourth power terminals may include first, second, third, and fourth contact portions, respectively, partially exposed from the first protruding part. The signal terminal may include a contact portion partially exposed from the second protruding part.

In the first mating connector of this aspect, the contact portion of the signal terminal, and the first, second, third, and fourth contact portions of the first, second, third, and fourth power terminals are exposed from different places (from the second and first protruding parts, respectively) of the body. This arrangement can prevent undesirable contact of the signal terminal with any of the third, fourth, first, and second contact portions of the third, fourth, first, and second terminals when bringing the first, second, third, and fourth power terminals into contact with the first, second, third, and fourth contact portions of the first, second, third, and fourth terminals. The above arrangement can also prevent undesirable contact of the first, second, third, and fourth power terminals with any of the contacts of the another type of connector when bringing the signal terminal with the contacts of the another type of connector.

The exposed parts of the first and second contact portions may be exposed from different places of the first protruding part. The exposed parts of the third and fourth contact portions may be exposed at different places of the first protruding part.

A second mating connector of the invention is connectable with a connector according to any of above aspects. The second mating connector includes a body, a signal terminal, a pair of power terminals. The body has an insulation property. The signal terminal is held by the body of the mating connector. The power terminals are held by the body of the mating connector. One of the power terminals is contactable with one of the first and second contact portions of the first and second terminals. The other power terminal is contactable with one of the third and fourth contact portions of the third and fourth terminals.

In the second mating connector of this aspect, one of the power terminal is in contact with one of the first and second contact portions of the first and second terminals, and the other power terminal is in contact with one of the third and fourth contact portions of the third and fourth terminals, allowing power supply through one electrical system. The second mating connector can perform signal transmission also with another type of connector, by bringing the signal terminal into contact with a terminal of the another type of connector.

The body of the mating connector may include a base, and first and second protruding parts. The first protruding part may be provided on the base. The second protruding part may be provided on the first protruding part. The power terminals may each include a contact portion partially exposed from the first protruding part. The signal terminal may include a contact portion partially exposed from the second protruding part.

In the second mating connector of this aspect, the contact portion of the signal terminal and the contact portions of the power terminals are exposed from the different places (from the second and first protruding parts, respectively) of the body. This arrangement can prevent undesirable contact of the signal terminal with any of the first, second, third, and fourth contact portions of the first, second, third, and fourth terminals when bringing one of the power terminal into contact with one of the first and second contact portions of the first and second terminals and the Other power terminal into contact with one of the third and fourth contact portions of the third and fourth terminals. The above arrangement can also prevent undesirable contact of the power terminals with any of the contacts of the another type of connector when bringing the signal terminal with the contacts of the another type of connector.

DESCRIPTION OF EMBODIMENTS

Figure 1:
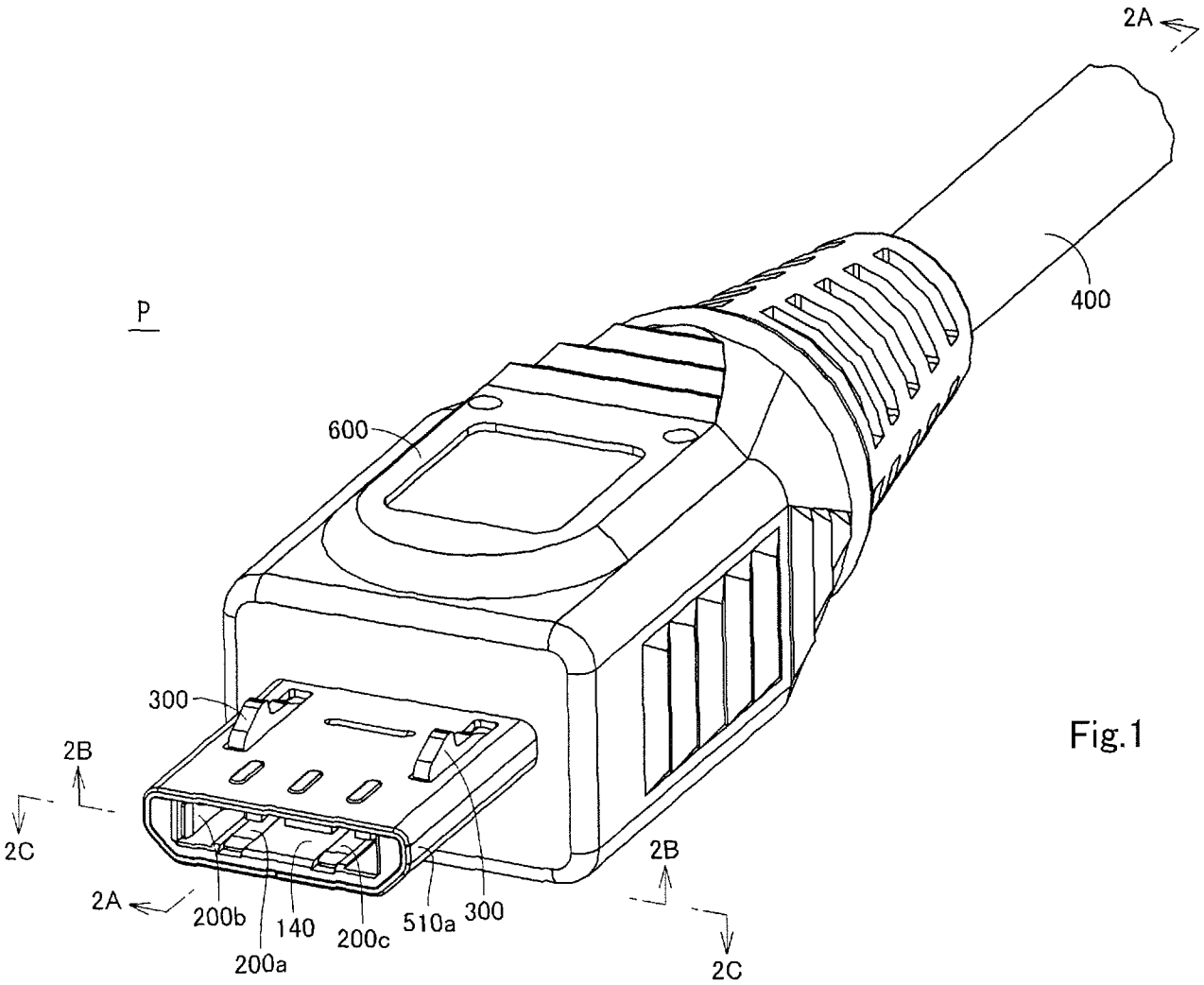
FIG. 1 is a perspective view of a connector in accordance with an embodiment of the invention as viewed from the front, top, right side.

A connector P in accordance with an embodiment of the invention will be described with reference to FIG. 1 to FIG. 7B. The connector P is a plug connector. The connector P includes a body 100, first, second, third, and fourth terminals 200*a*, 200*b*, 200*c*, and 200*d*, a pair of lock pieces 300, a cable 400, shield cases 500*a* and 500*b*, a case 600, and an insulating tape 700. These constituents of the connector P will be described below in detail. X1 shown in FIG. 3A to FIG. 7B represents a widthwise direction of the connector P, and X2 represents the other widthwise direction of the connector P. Y1 represents a lengthwise direction of the connector P, and Y2 represents the other lengthwise direction of the connector P. Z1 represents a heightwise direction of the connector P, and Z2 represents the other heightwise direction of the connector P. The Y1-Y2 direction is orthogonal to the X1-X2 direction, and the Z1-Z2 direction is orthogonal to the X1-X2 direction and the Y1-Y2 direction.

The body 100 as shown in FIGS. 2A to 2C and 4A to 5B is made of insulating resin. The body 100 includes a base 110, a protruding part 120, first and second recesses 130*a* and 130*b*, a connection part 140, housing parts 150*a*, 150*b*, 150*c*, and 150*d*, and a pair of housing parts 160.

Figure 4A:
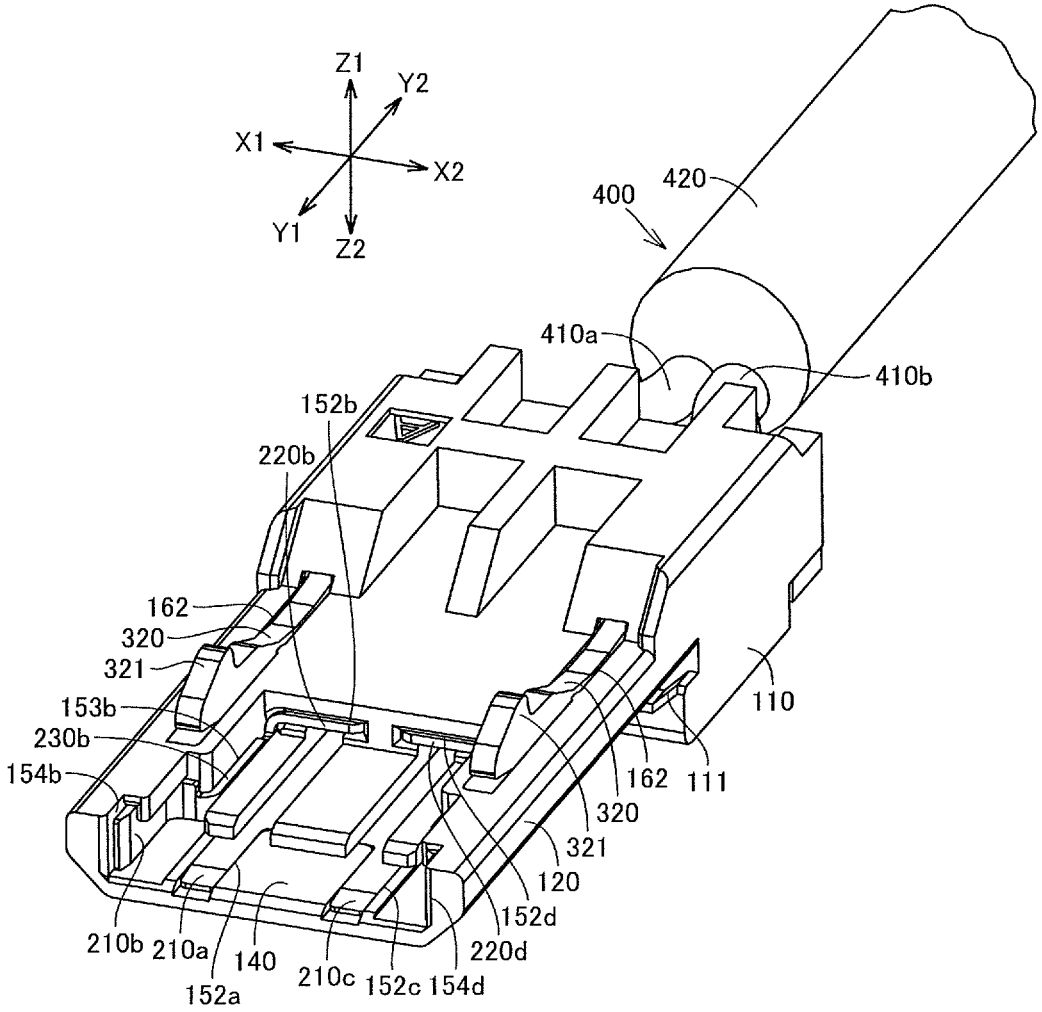
FIG. 4A is a perspective view of the body, the terminals, the lock pieces, and the cable of the connector as viewed from the front, top, right side.
Figure 5A:
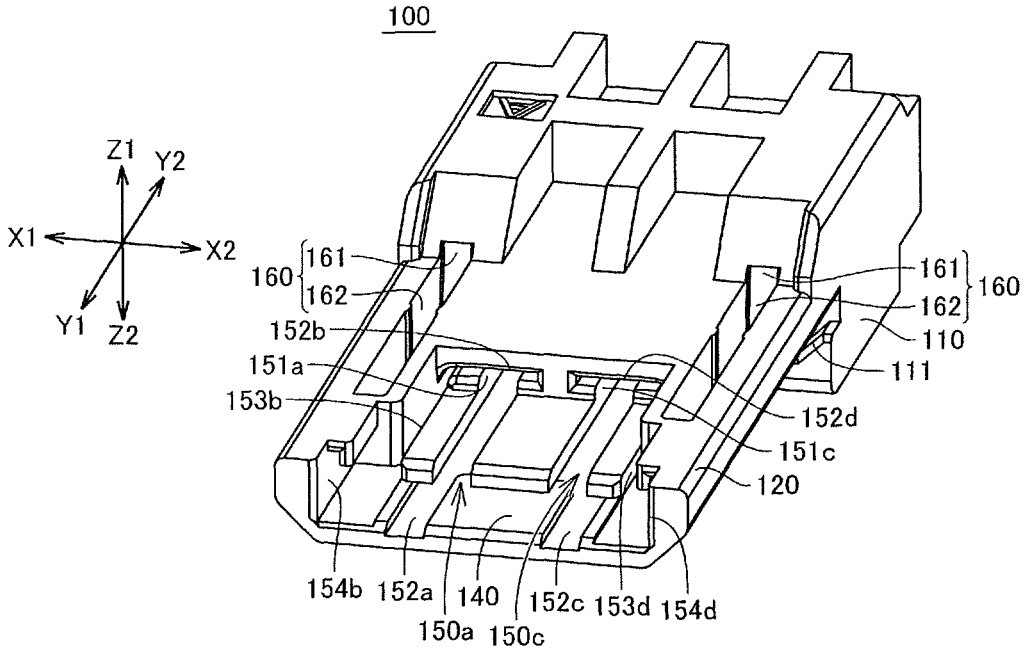
FIG. 5A is a perspective view of the body of the connector as viewed from the front, top, right side.

The base 110 is a block made of insulating resin. As shown in FIG. 4A and FIG. 5A, the base 110 is provided with two recesses aligned in the X1-X2 direction, in the Z1 direction portion (upper portion) of the Y2-direction end of the base 110 (the Y2-direction end (rear end) of the body 100).

Figure 2A:
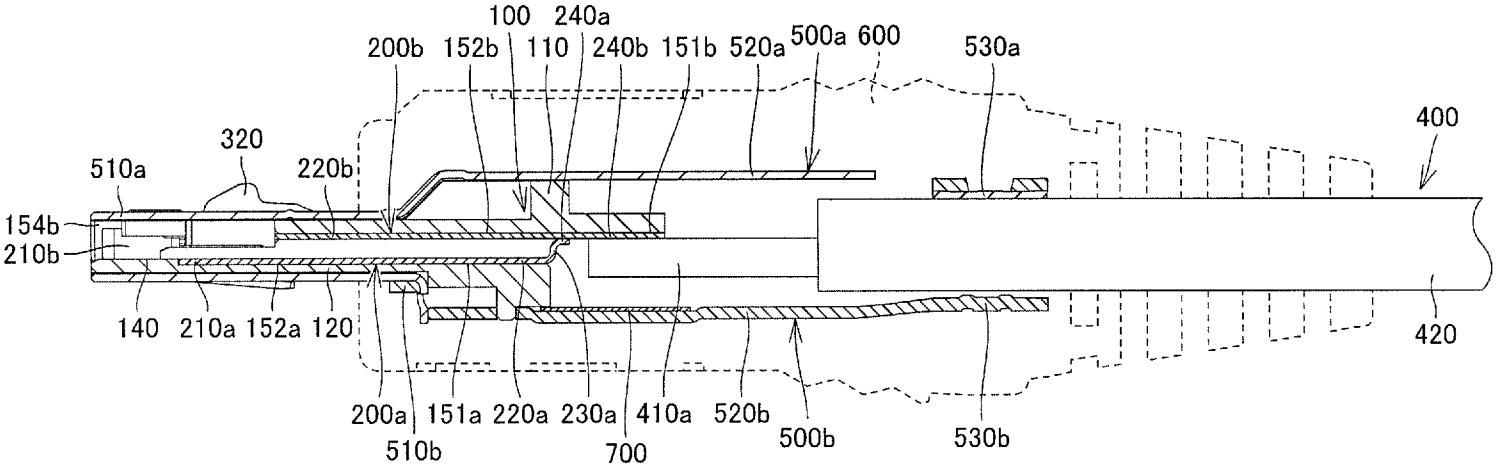
FIG. 2A is a cross-sectional view of the connector taken along 2A-2A in FIG. 1, with a case illustrated as transparent.
Figure 2B:
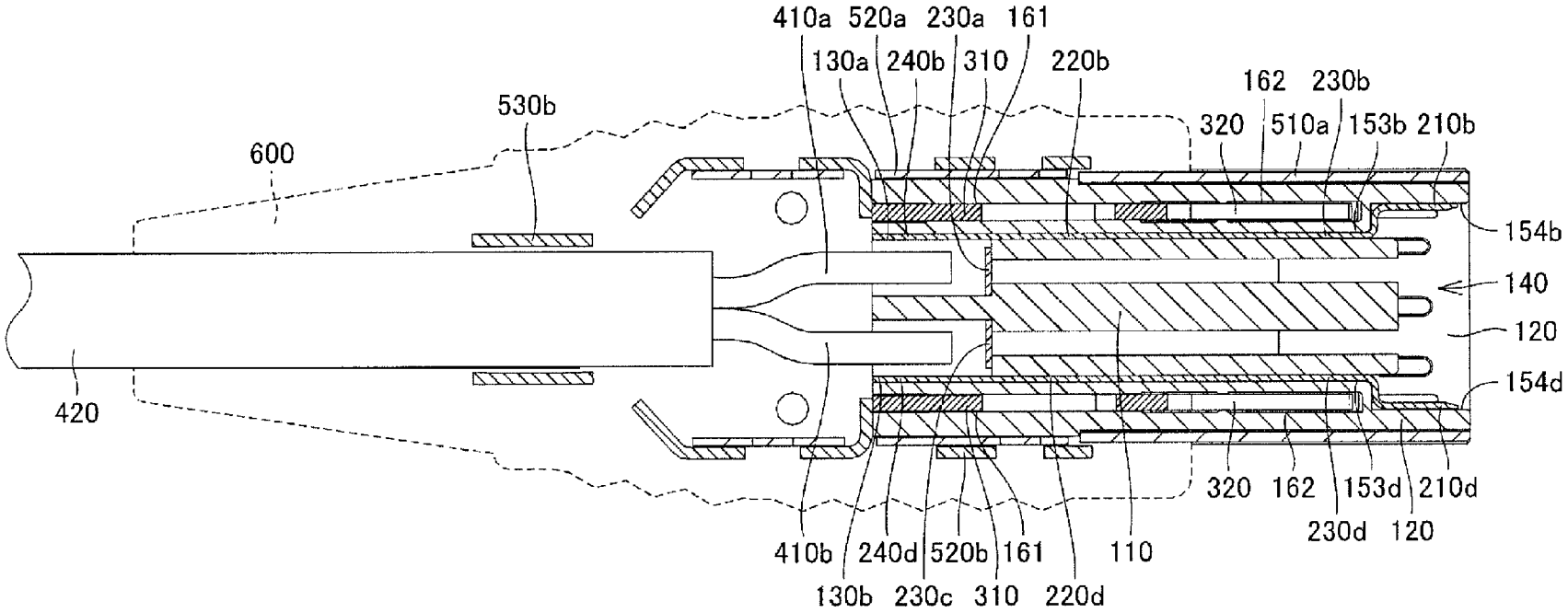
FIG. 2B is a cross-sectional view of the connector taken along 2B-2B in FIG. 1, with the case illustrated as transparent.
Figure 2C:
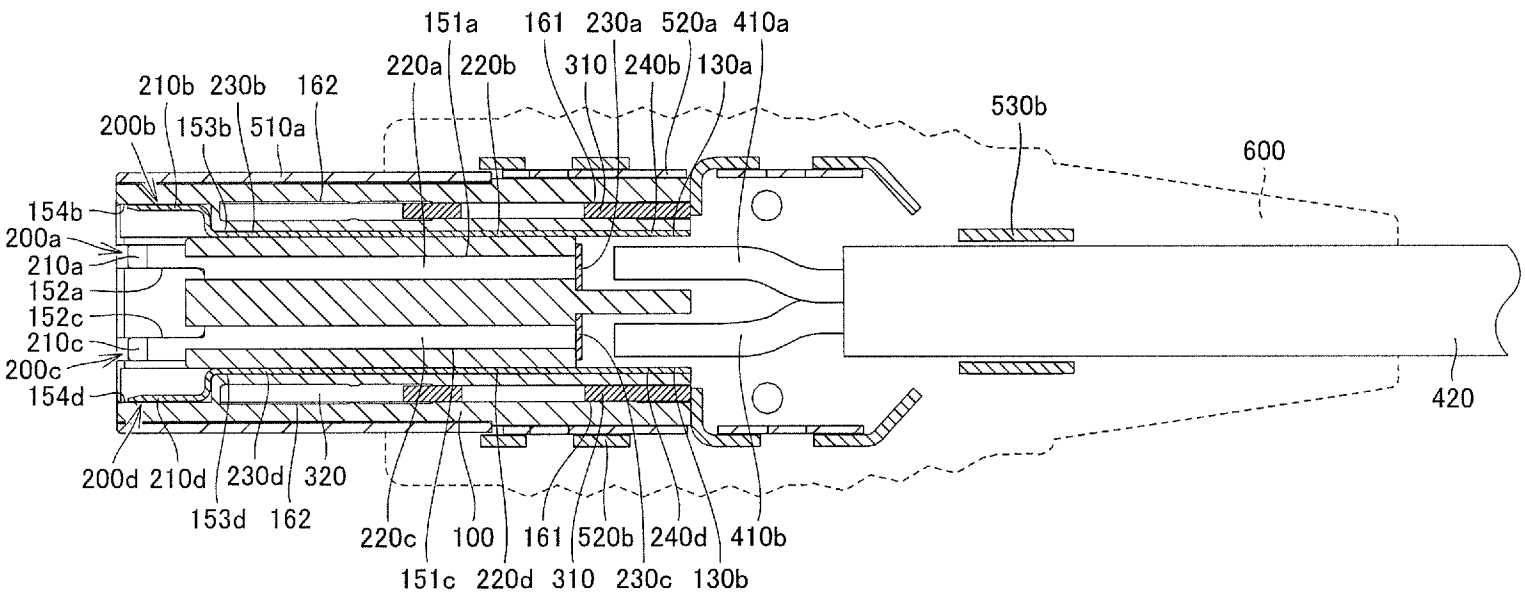
FIG. 2C is a sectional view of the connector taken along 2C-2C in FIG. 1, with the case illustrated as transparent.
Figure 4B:
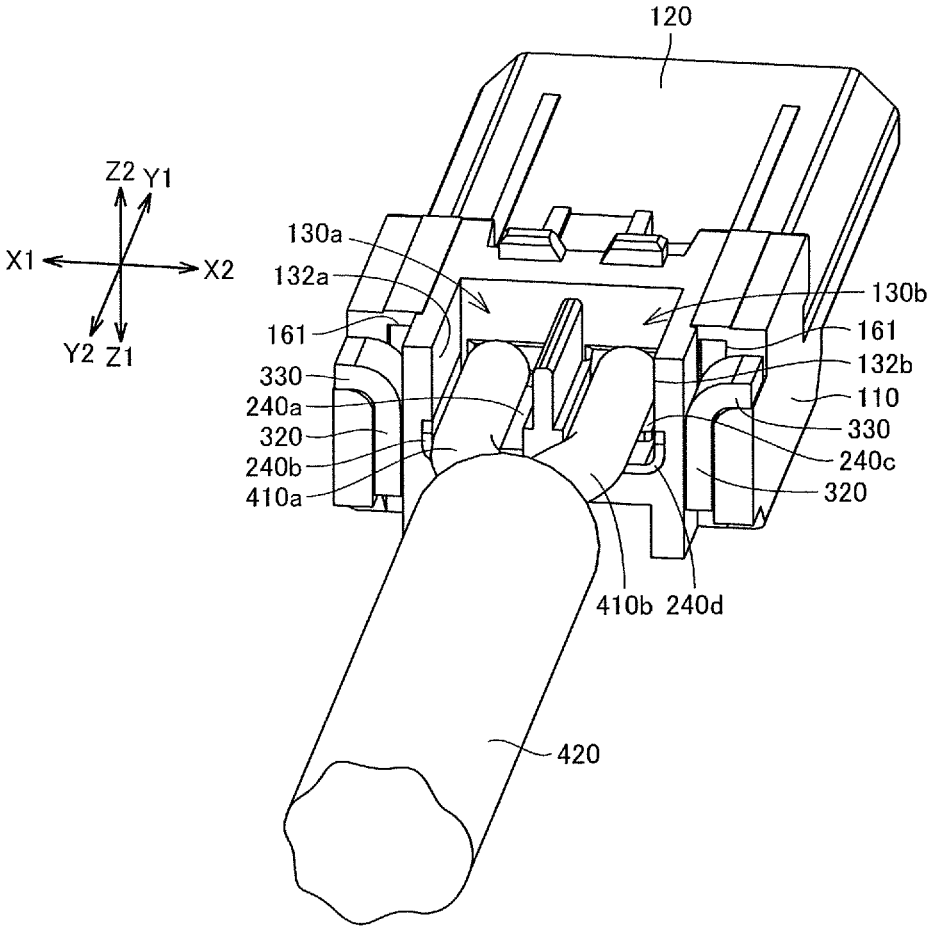
FIG. 4B is a perspective view of the body, the terminals, the lock pieces, and the cable of the connector as viewed from the back, bottom, right side.
Figure 4C:
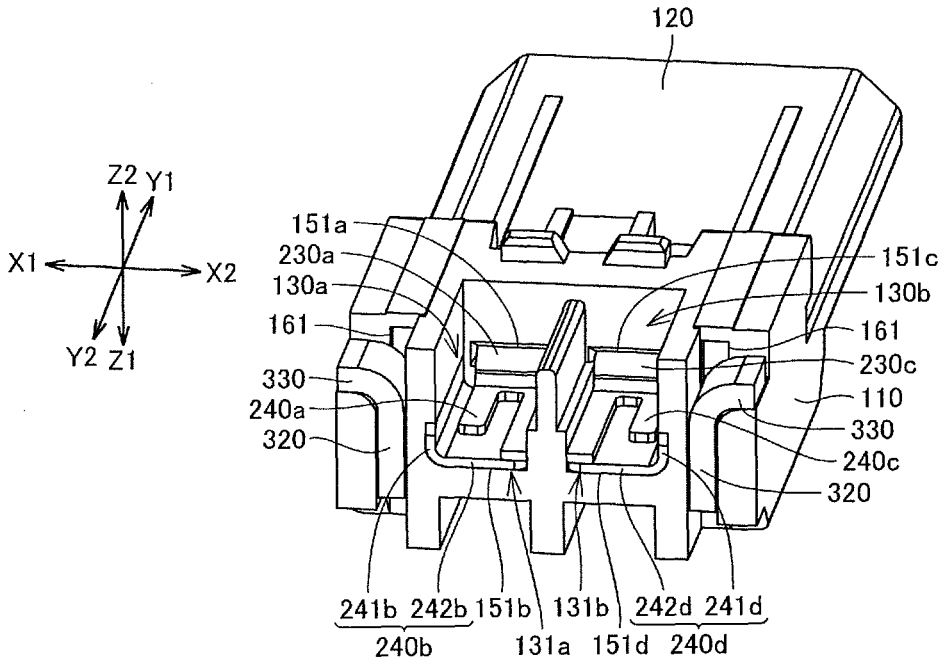
FIG. 4C is a perspective view of the body, the terminals, and the lock pieces of the connector as viewed from the back, bottom, right side.
Figure 5B:
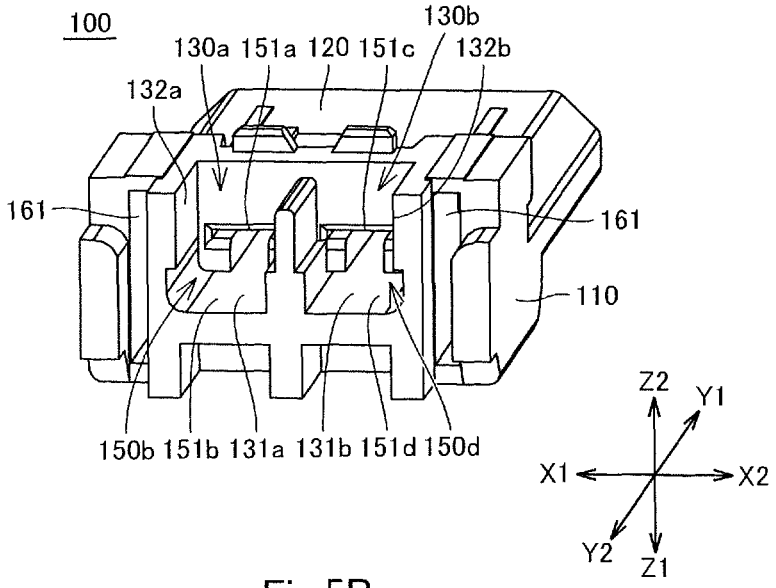
FIG. 5B is a perspective view of the body of the connector as viewed from the back, bottom, right side.
Figure 6A:
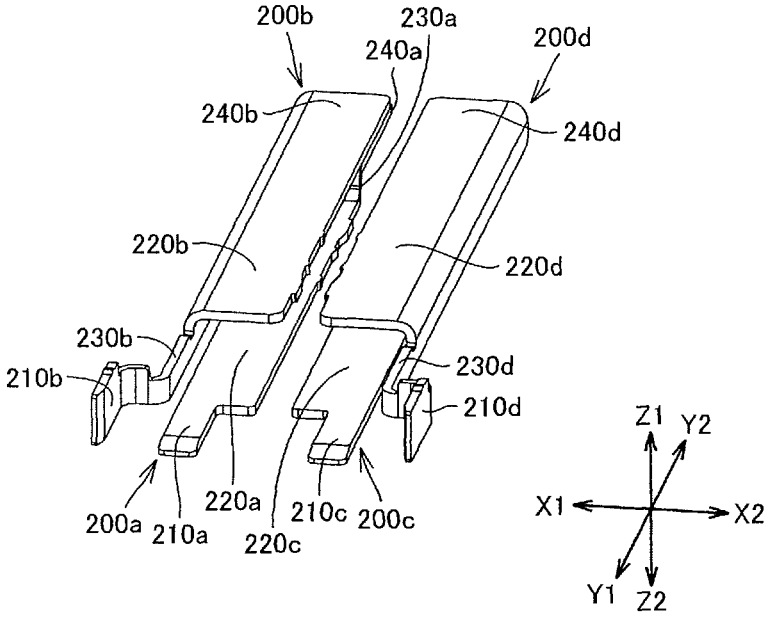
FIG. 6A is a perspective view of the terminals of the connector as viewed from the, top, right side.
Figure 6B:
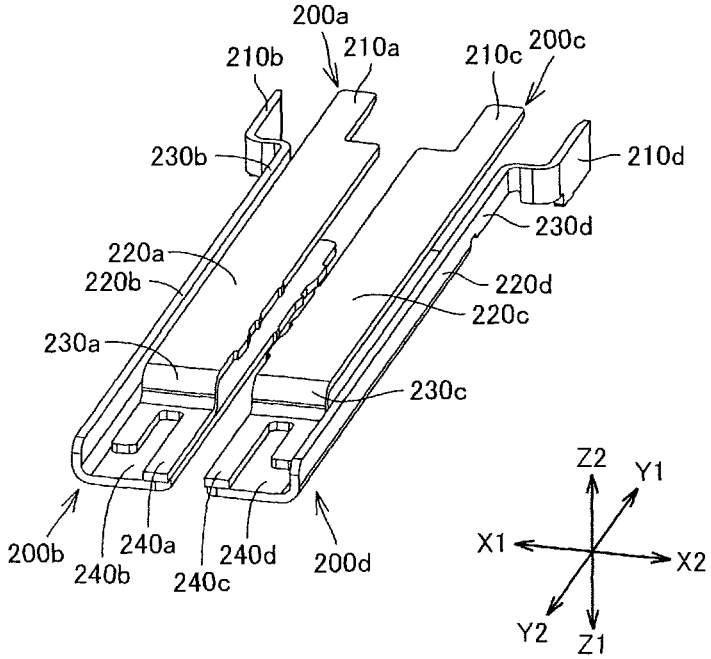
FIG. 6B is a perspective view of the terminals of the connector as viewed from the back, bottom, right side.

As shown in FIG. 4B, FIG. 4C, and FIG. 5B, the first and second recesses 130*a* and 130*b* align in the X1-X2 direction, in the Z2 direction portion (lower portion) of the Y2-direction end of the base 110. The first and second recesses 130*a* and 130*b* are generally rectangular recesses opening in the Y2 and Z2 directions. The first recess 130*a* has a first bottom 131*a* and a first side wall 132*a* substantially perpendicular to the first bottom 131*a*. The first side wall 132*a* is a wall in the X1 direction (on the outer side) of the first recess 130*a*. The second recess 130*b* has a second bottom 131*b* and a second side wall 132*b* substantially perpendicular to the second bottom 131*b*. The second side wall 132*b* is a wall in the X2 direction (on the outer side) of the second recess 130*b*. As shown in FIG. 2A, the insulating tape 700 covers the first and second recesses 130*a* and 130*b*.

As shown in FIG. 4A to FIG. 5B, the protruding part 120 extends from the Z1-Z2 direction center of the Y1-direction end of the base 110. The protruding part 120 is an insulating resin plate. Generally U-shaped slits 111 are provided at the Y1-direction end of the base 110, on the Z2-direction side of the protruding part 120.

The Y1-direction end portion of the protruding part 120 includes the connection part 140. The connection part 140 is a recess opening in the Y1 direction (to the front side) and the Z1 direction (to the upper side).

The housing part 150*a* serves to house the first terminal 200*a* and has an engaging hole 151*a* and a groove 152*a* as shown in FIG. 5A and FIG. 5B. The engaging hole 151*a* has a rectangular cross section, extending from the wall on the Y1-direction side of the first recess 130*a* to the wall on the Y2-direction side of the connection part 140. The groove 152*a* is provided in the bottom of the connection part 140 and communicates with the engaging hole 151*a*. The groove 152*a* extends in the Y1 direction.

The housing part 150*c* serves to house the third terminal 200*c* and is symmetric to the housing part 150*a* as shown in FIG. 5A and FIG. 5B. The housing part 150*c* has an engaging hole 151*c* and a groove 152*c*. The engaging hole 151*c* is has a rectangular cross section, extending from the wall on the Y1-direction side of the second recess 130*b* to the wall on the Y2-direction side of the connection part 140. The groove 152*c* is provided in the bottom of the connection part 140 and communicates with the engaging hole 151*c*. The groove 152*c* extends in the Y1 direction.

The housing part 150*b* serves to house the second terminal 200*b* and is located on the Z1-direction side (upper side) of the housing part 150*a* as shown in FIG. 5A and FIG. 5B. The housing part 150*b* includes an L-shaped recess 151*b*, an engaging hole 152*b*, a slit 153*b*, and a housing recess 154*b*. The L-shaped recess 151*b* is generally L-shaped in the X1-X2 direction cross section, provided in the first bottom 131*a* and the first side wall 132*a* of the first recess 130*a* of the base 110. The L-shaped recess 151*b* consists of a bottom region and a side region. The bottom region is provided in the first bottom 131*a*. The side region is provided in the first side wall 132*a* and communicates with the bottom region. The engaging hole 152*b* is generally L-shaped in the X1-X2 direction cross section, extending from the wall on the Y1-direction side of the first recess 130*a* to the wall on the Y2-direction side of the connection part 140. The engaging hole 152*b* communicates with the L-shaped recess 151*b*. As shown in FIG. 2A, FIG. 4C, and FIG. 5A, the engaging hole 152*b* is located on the Z1-direction side (upper side) of the engaging hole 151*a* of the housing part 150*a*. The engaging hole 152*b* and the engaging hole 151*a* communicate with each other through a rectangular communicating hole. The engaging hole 152*b* consists of a horizontal portion and a vertical portion. As shown in FIG. 4A and FIG. 5A, the slit 153*b* is provided in a bottom of the connection part 140 and communicates with the vertical portion of the engaging hole 152*b*. The slit 153*b* extends in the Y1 direction. The slit 153*b* is located on the X1-direction side of the groove 152*a*. The housing recess 154*b* is provided in the side wall on the Y1-direction side of the connection part 140.

The housing part 150*d* serves to house the fourth terminal 200*d*, and as shown in FIG. 5A and FIG. 5B, it is symmetric to the housing part 150*b* and is located on the Z1-direction side (upper side) of the housing part 150*c*. The housing part 150*d* includes an L-shaped recess 151*d*, an engaging hole 152*d*, a slit 153*d*, and a housing recess 154*d*. The L-shaped recess 151*d* is generally L-shaped in the X1-X2 direction cross section, provided in the second bottom 131*b* and the second side wall 132*b* of the second recess 130*b* of the base 110. The L-shaped recess 151*d* consists of a bottom region and a side region. The bottom region is provided in the second bottom 131*b*. The side region is provided in the second side wall 132*b* and communicates with the bottom region. The engaging hole 152*d* generally L-shaped in the X1-X2 direction cross section, extending from the wall on the Y1-direction side of the second recess 130*b* to the wall on the Y2-direction side of the connection part 140. The engaging hole 152*d* communicates with the L-shaped recess 151*d*. As shown in FIG. 4C and FIG. 5A, the engaging hole 152*d* is located on the Z1-direction side (upper side) of the engaging hole 151*c* of the housing part 150*c*. The engaging hole 152*d* and the engaging hole 151*c* communicate with each other through a rectangular communicating hole. The engaging hole 152*d* consists of a horizontal portion and a vertical portion. As shown in FIG. 4A and FIG. 5A, the slit 153*d* is provided in a bottom of the connection part 140 and communicates with the vertical portion of the engaging hole 152*d*. The slit 153*d* extends in the Y1 direction. The slit 153*d* is located on the X2-direction side of the groove 152*c*. The housing recess 154*d* is provided in the side wall on the X2-direction side of the connection part 140.

The housing parts 160 serve to house the lock pieces 300 and each have an engaging hole 161 and a slit 162 as shown in FIG. 2B, FIG. 2C and FIG. 5A to FIG. 5B. The engaging holes 161 extend from the end face on the Y2 direction of the base 110 to the end face on the Y1 direction of the base 110. One of the engaging holes 161 is located on the X1-direction side of the first recess 130*a*, the engaging hole 151*a* of the housing part 150*a*, and the engaging hole 152*b* of the housing part 150*b*. The other engaging hole 161 is located on the X2-direction side of the second recess 130*b*, the engaging hole 151*c* of the housing part 150*c*, and the engaging hole 152*d* of the housing part 150*d*. The slits 162 of the housing parts 160 are provided near the X1 and X2 ends, respectively, of the protruding part 120 and communicate with the respective engaging holes 161. The slits 162 extend in the Y1 direction and open in the Z1 direction. One of the slits 162 is located on the X1-direction side of the engaging hole 151*a* of the housing part 150*a*, the engaging hole 152*b* of the housing part 150*b*, and the connection part 140. The other slit 162 is located on the X2-direction side of the engaging hole 151*c* of the housing part 150*c*, the engaging hole 152*d* of the housing part 150*d*, and the connection part 140.

The first terminal 200*a* is a positive (Vcc) power terminal held by the body 100 as shown in FIGS. 2A to 2C, 4A to 4C, and 6A to 6B. The first terminal 200*a* is formed of a metal plate. The first terminal 200*a* includes a first contact portion 210*a*, a first engaging portion 220*a*, a first bent portion 230*a*, and a first connecting portion 240*a*.

The first engaging portion 220*a* is a rectangular metal plate extending in the Y1-Y2 direction. The first engaging portion 220*a* is received in and engaged with the engaging hole 151*a* of the housing part 150*a* of the body 100. The first contact portion 210*a* is a generally L-shaped metal plate contiguous with the Y1-direction end of the first engaging portion 220*a*. The first contact portion 210*a* is received in the groove 152*a* of the housing part 150*a* and partially exposed from the groove 152*a* to the connection part 140. The first bent portion 230*a* is a metal plate contiguous with the Y2-direction end of the first engaging portion 220*a* and is bent in the Z1 direction. The first bent portion 230*a* is housed in the first recess 130*a* of the body 100. The first connecting portion 240*a* is a metal plate contiguous with the first bent portion 230*a* and extends in the Y2 direction. The first connecting portion 240*a* is disposed on the first bottom 131*a* of the first recess 130*a*. The first connecting portion 240*a* has X1- and X2-direction end portions. The middle area between the X1- and X2-direction end portions of the first connecting portion 240*a* is cut-out (hereinafter referred to as first cut-out). The X1-direction end portion is cut away at its Y2-direction end such that the X1-direction end portion is smaller in length in the Y1-Y2 direction than the X2-direction end portion (hereinafter referred to as second cut-out).

The third terminal 200*c* is a negative (GND) power terminal held by the body 100 as shown in FIGS. 2B to 2C, 4A to 4C, and 6A to 6B. The third terminal 200*c* is formed of a metal plate. The third terminal 200*c* is symmetric to the first terminal 200*a*, only the differences between them will be described. The third terminal 200*c* includes a third engaging portion 220*c* received in and engaged with the engaging hole 151*c* of the housing part 150*c* of the body 100. The third terminal 200*c* includes a third contact portion 210*c* received in the groove 152*c* of the housing part 150*c* and partially exposed from the groove 152*c* to the connection part 140. The third terminal 200*c* includes a third bent portion 230*c* housed in the second recess 130*b* of the body 100. The third terminal 200*c* includes a third connecting portion 240*c* disposed on the second bottom 131*b* of the second recess 130*b*. The third connecting portion 240*c* has X1- and X2-direction end portions. The middle area between the X1- and X2-direction end portions of the third connecting portion 240*c* is cut-out (hereinafter referred to as first cut-out). The X2-direction end portion is cut away at its Y2-direction end such that the X2-direction end portion is smaller in length in the Y1-Y2 direction than the X1-direction end portion (hereinafter referred to as second cut-out).

The second terminal 200*b* is a positive (Vcc) power terminal held by the body 100 as shown in FIGS. 2A to 2C, 4A to 4C, and 6A to 6B. The second terminal 200*b* is formed of a metal plate. The second terminal 200*b* has a second contact portion 210*b*, a second engaging portion 220*b*, a second extended portion 230*b*, and a second connecting portion 240*b*.

The second engaging portion 220*b* is a metal plate extending in the Y1-Y2 direction and has a generally L-shaped cross section in the X1-X2 direction. The second engaging portion 220*b* is received in and engaged with the engaging hole 152*b* of the housing part 150*b* of the body 100. The second engaging portion 220*b* consists of a horizontal portion and a vertical portion. The second extended portion 230*b* is a metal plate of generally L-shaped cross section in the Y1-Y2 direction and contiguous with the Y1-direction end of the vertical portion of the second engaging portion 220*b*. The second extended portion 230*b* consists of a first portion extending in the Y1 direction and a second portion bent substantially perpendicular to the first portion. The first portion of the second extended portion 230*b* is received in the slit 153*b* of the housing part 150*b*. The second portion of the second extended portion 230*b* is disposed along the wall on the Y2-direction side of the housing recess 154*b* of the housing part 150*b*. The second contact portion 210*b* is a metal plate contiguous with the second portion of the second extended portion 230*b*. The second contact portion 210*b* is disposed along the wall on the X1-direction side of the housing recess 154*b* of the housing part 150*b*. As described above, the first and second contact portions 210*a* and 210*b* are exposed from different places (groove 152*a* of the housing part 150*a* and the housing recess 154*b* of the housing part 150*b*, respectively) of the connection part 140.

The second connecting portion 240*b* is a metal plate having a generally L-shaped cross section in the X1-X2 direction and, contiguous with the Y2-direction end of the second engaging portion 220*b*. The second connecting portion 240*b* consists of a first portion 241*b* and a second portion 242*b*. The first portion 241*b* is housed in the side region of the L-shaped recess 151*b* in the first recess 130*a*. In other words, the first portion 241*b* is provided in the first side wall 132*a* of the first recess 130*a* so as to be exposed from the first side wall 132*a*. The second portion 242*b* is a metal plate contiguous with the Z2-direction end of the first portion 241*b* and bent substantially perpendicular to the first portion 241*b*. The second portion 242*b* is housed in the bottom region of the L-shaped recess 151*b* of the first recess 130*a*. In other words, the second portion 242*b* is provided in the first bottom 131*a* of the first recess 130*a* so as to be exposed from the first bottom 131*a*. The second portion 242*b* is located under and in contact with the first connecting portion 240*a* of the first terminal 200*a*. The second portion 242*b* is exposed from the first and second cut-outs of the first connecting portion 240*a*. It should be noted that the first connecting portion 240*a* has smaller outer dimensions than the second portion 242*b*.

The fourth terminal 200*d* is a negative (GND) power terminal held by the body 100 as shown in FIGS. 2B to 2C, 4A to 4C, and 6A to 6B. The fourth terminal 200*d* is formed of a metal plate. Since the fourth terminal 200*d* is symmetric to the second terminal 200*b*, only the differences between them will be described below. The fourth terminal 200*d* includes a fourth engaging portion 220*d* received in and engaged with the engaging hole 152*d* of the housing part 150*d* of the body 100. The fourth terminal 200*d* includes a fourth extended portion 230*d* consisting of first and second portions. The first portion is received in the slit 153*d* of the housing part 150*d*, and the second portion is disposed along the wall on the Y2-direction side of the housing recess 154*d* of the housing part 150*d*.

Also, the fourth terminal 200*d* includes a fourth contact portion 210*d* disposed along the wall on the X2-direction side of the housing recess 154*d* of the housing part 150*d*. As described above, the third and fourth contact portions 210*c* and 210*d* are exposed from different places (the groove 152*c* of the housing part 150*c* and the housing recess 154*d* of the housing part 150*d*, respectively) of the connection part 140. The fourth connecting portion 240*d* of the fourth terminal 200*d* consists of a first portion 241*d* and a second portion 242*d*. The first portion 241*d* is housed in the side region of the L-shaped recess 151*d* in the second recess 130*b*. In other words, the first portion 241*d* is provided in the second side wall 132*b* of the second recess 130*b* so as to be exposed from the second side wall 132*b*. The second portion 242*d* of the fourth connecting portion 240*d* is housed in the bottom region of the L-shaped recess 151*d* of the second recess 130*b*. In other words, the second portion 242*d* is provided in the second bottom 131*b* of the second recess 130*b* so as to be exposed from the second bottom 131*b*. The second portion 242*d* is located under and in contact with the third connecting portion 240*c* of the third terminal 200*c*. The second portion 242*d* is exposed from the first and second cut-outs of the third connecting portion 240*c*. It should be noted that the third connecting portion 240*c* has smaller outer dimensions than the second portion 242*d*.

Figure 7A:
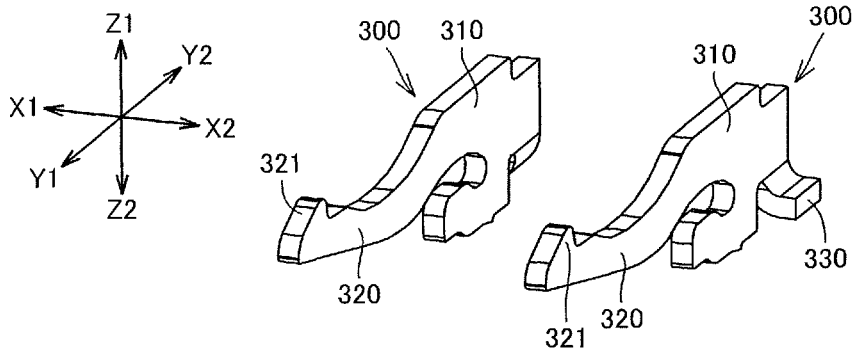
FIG. 7A is a perspective view of the lock pieces of the connector as viewed from the front, top, right side.
Figure 7B:
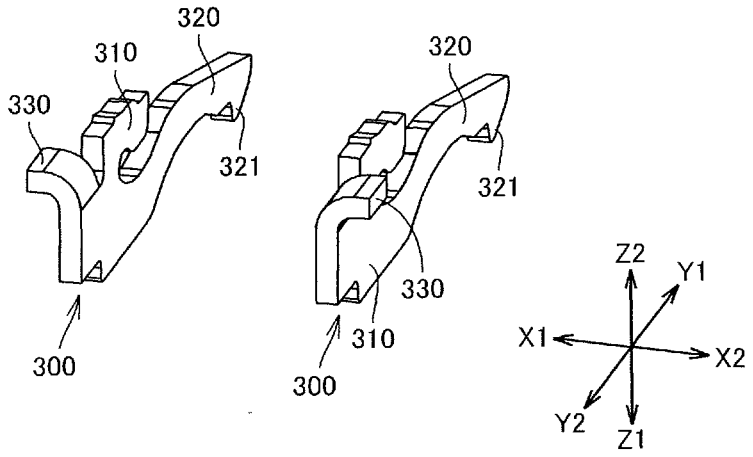
FIG. 7B is a perspective view of the lock pieces of the connector as viewed from the back, the bottom, and the right side.
Figure 8A:
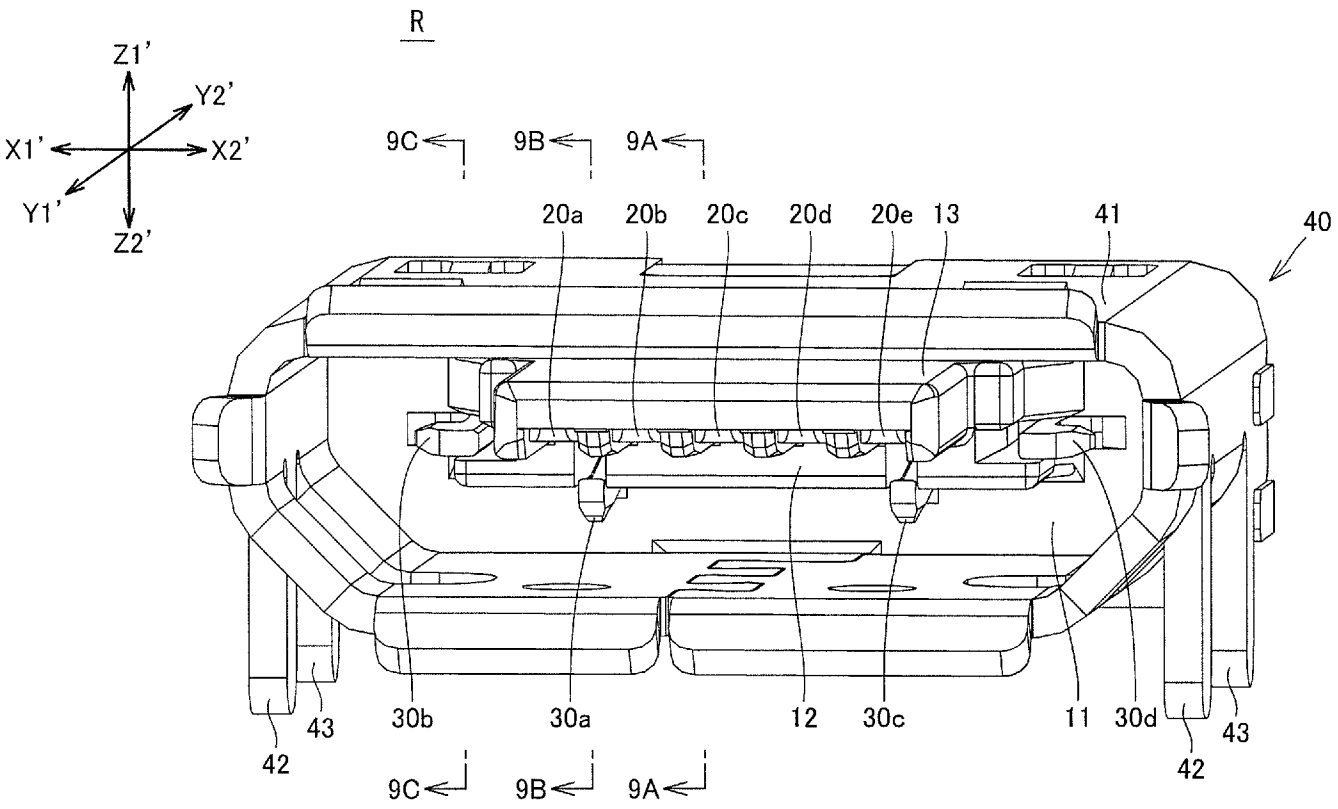
FIG. 8A is a perspective view of a mating connector in accordance with an embodiment of the invention as viewed from the front, top, right side.
Figure 8B:
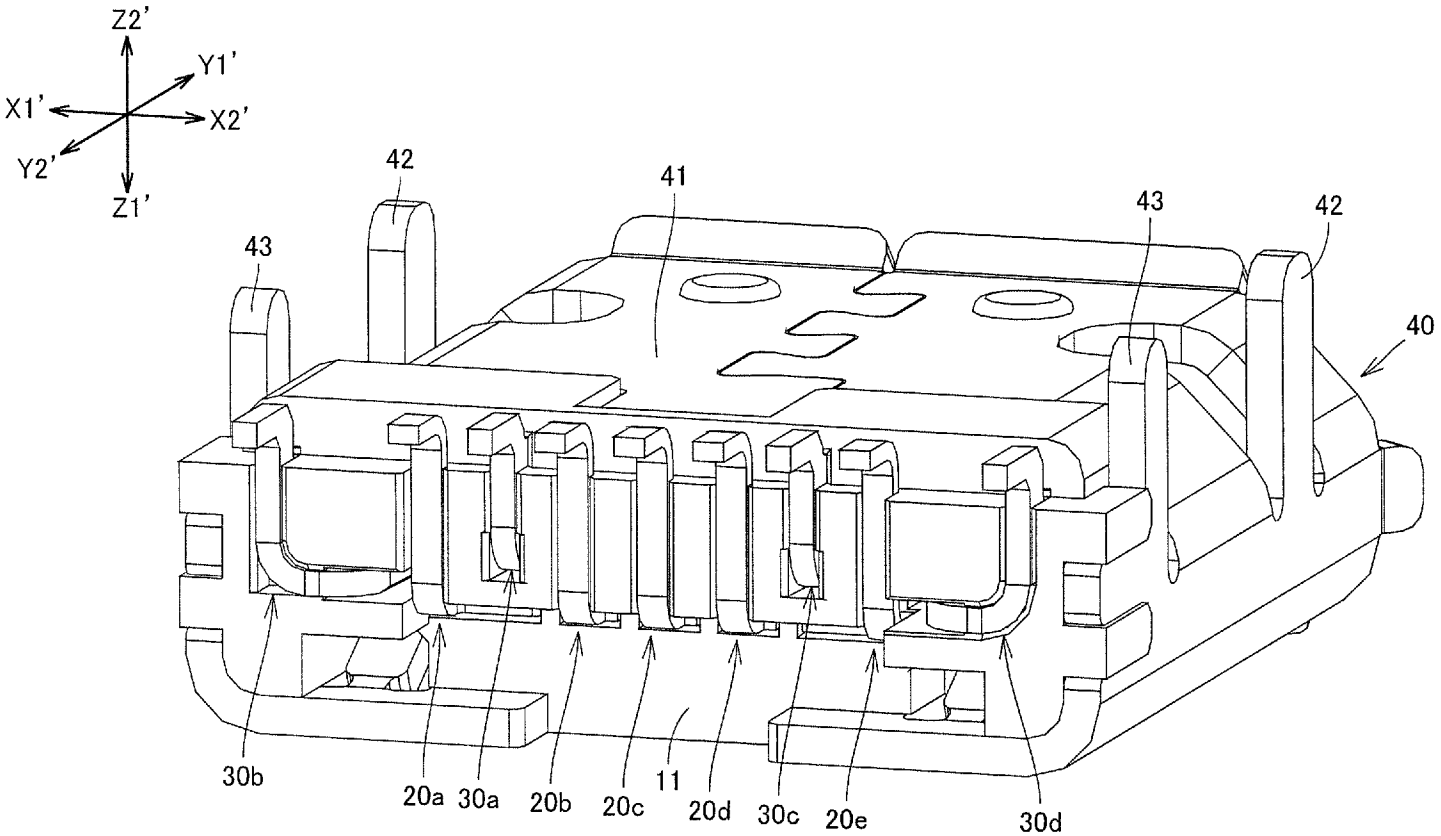
FIG. 8B is a perspective view of the mating connector as viewed from the back, bottom, right side.

As shown in FIG. 7A to FIG. 7B, the lock pieces 300 each have a fixing portion 310, an arm 320, and an abutting portion 330. The fixing portions 310 each are generally C-shaped plates. As shown in FIGS. 2B to 2C and 4B to 4C, the fixing portions 310 are received in and engaged with the associated engaging holes 161 of the housing parts 160 of the body 100. The fixing portions 310 each have two Y1-direction end portions and an Y2-direction end portion. Each arm 320 is contiguous with one of the Y1-direction end portions (one on the Z1-direction side) of each fixing portion 310 and extends in the Y1 direction. The front end of each arm 320 is provided with a claw 321 projecting in the Z1 direction. As shown in FIG. 4A, the arms 320 are housed in the respective slits 162 of the housing parts 160, allowing the claws 321 to protrude from the slits 162 in the Z1 direction. The arms 320 are elastically deformable in the Z2 direction. Elastic deformation of the arms 320 make the claws 321 be received in the respective slits 162. The abutting portions 330 are plates formed by cutting and bending Z2 direction portions (lower portions) of the Y2-direction end portions of the fixing portion 310. The abutting portions 330 abut the body 100 to position the fixing portions 310 and the arms 320 in the housing parts 160.

As shown in FIG. 2A to FIG. 4B, the cable 400 has first and second core wires 410*a* and 410*b* (first and second connection objects) and an insulator 420. The insulator 420 is a cylinder that covers the first and second core wires 410*a* and 410*b*. The first core wire 410*a* is on the positive side (Vcc side). The second core wire 410*b* is on the negative side (GND side). A lengthwise end of each of the first and second core wires 410*a* and 410*b* protrudes from the insulator 420. The one end of the first core wire 410*a* is received in the first recess 130*a* of the body 100 and soldered to the first connecting portion 240*a* of the first terminal 200*a* and the second connecting portion 240*b* (the first and second portions 241*b* and 242*b*) of the second terminal 200*b*. The one end of the second core wire 410*b* is received in the second recess 130*b* of the body 100 and soldered to the third connecting portion 240*c* of the third terminal 200*c* and the fourth connecting portion 240*d* (the first and second portions 241*d* and 242*d*) of the fourth terminal 200*d*. The other lengthwise end of each of the first and second core wires 410*a* and 410*b* are connectable to an adaptor not shown. The first and second core wires 410*a* and 410*b* are connectable to the power source via the adaptor.

The shield case 500*a* as shown in FIG. 2A to FIG. 3B is formed of a metal plate. The shield case 500*a* includes a tube 510*a*, a cup 520*a*, and a cable holder 530*a*. The cup 520*a* has a generally inverted U-shaped cross section. The cup 520*a* is placed over the base 110 from the Z1 direction. The X1- and X2-direction ends of the cup 520*a* are provided with a plurality of engaging pieces 521*a*.

The tube 510*a* is contiguous with the Y1-direction end of the cup 520*a*. The inner shape of the tube 510*a* conforms to the outer shape of the protruding part 120 of the body 100. The tube 510*a* fits around the protruding part 120. The tube 510*a* covers the openings in the Z1 direction of the connection part 140 of the protruding part 120, the housing recess 154*b* and the housing recess 154*d*. The tube 510*a*, the connection part 140, the housing recess 154*b*, and the housing recess 154*d* define a connection hole of the connector P. The plate on the Z1-direction side (upper plate) of the tube 510*a* is provided with a pair of openings 511*a* at positions corresponding to the slits 162 of the body 100. The openings 511*a* let through the claws 321 of the arms 320 of the lock pieces 300. The plate on the Z2-direction side (lower plate) of the tube 510*a* is provided with a pair of engaging pieces 512*a*.

The cable holder 530*a* is a plate contiguous with the Y2-direction end of the cup 520*a* and extends in the Y2 direction. The distal portion of the cable holder 530*a* abuts the insulator 420 of the cable 400.

The shield case 500*b* as shown in FIG. 2A to FIG. 3B is formed of a metal plate. The shield case 500*b* has a tongue 510*b*, a cup 520*b*, and a cable holder 530*b*. The cup 520*b* has a generally U-shaped cross section. The cup 520*b* is placed over the base 110 and the cup 520*a* from the Z2 direction. That is, the cups 520*a* and 520*b* surround the outer circumference of the base 110. The X1- and X2-direction ends of the cup 520*b* are provided with a plurality of engaging holes 521*b*. The engaging holes 521*b* of the cup 520*b* are engaged with the engaging pieces 521*a* of the cup 520*a*. The cup 520*b* contacts the insulating tape 700, which closes the first and second recesses 130*a* and 130*b*. The insulating tape 700 insulates the cup 520*b* from the solder in the first and second recesses 130*a* and 130*b*, preventing short-circuit therebetween. As described above, the solder in the first recess 130*a* connects the first core wire 410*a* to the first connecting portion 240*a* of the first terminal 200*a* and to the second connecting portion 240*b* of the second terminal 200*b*. The solder in the second recess 130*b* connects the second core wire 410*b* to the third connecting portion 240*c* of the third terminal 200*c* and to the fourth connecting portion 240*d* of the fourth terminal 200*d*.

Figure 3A:
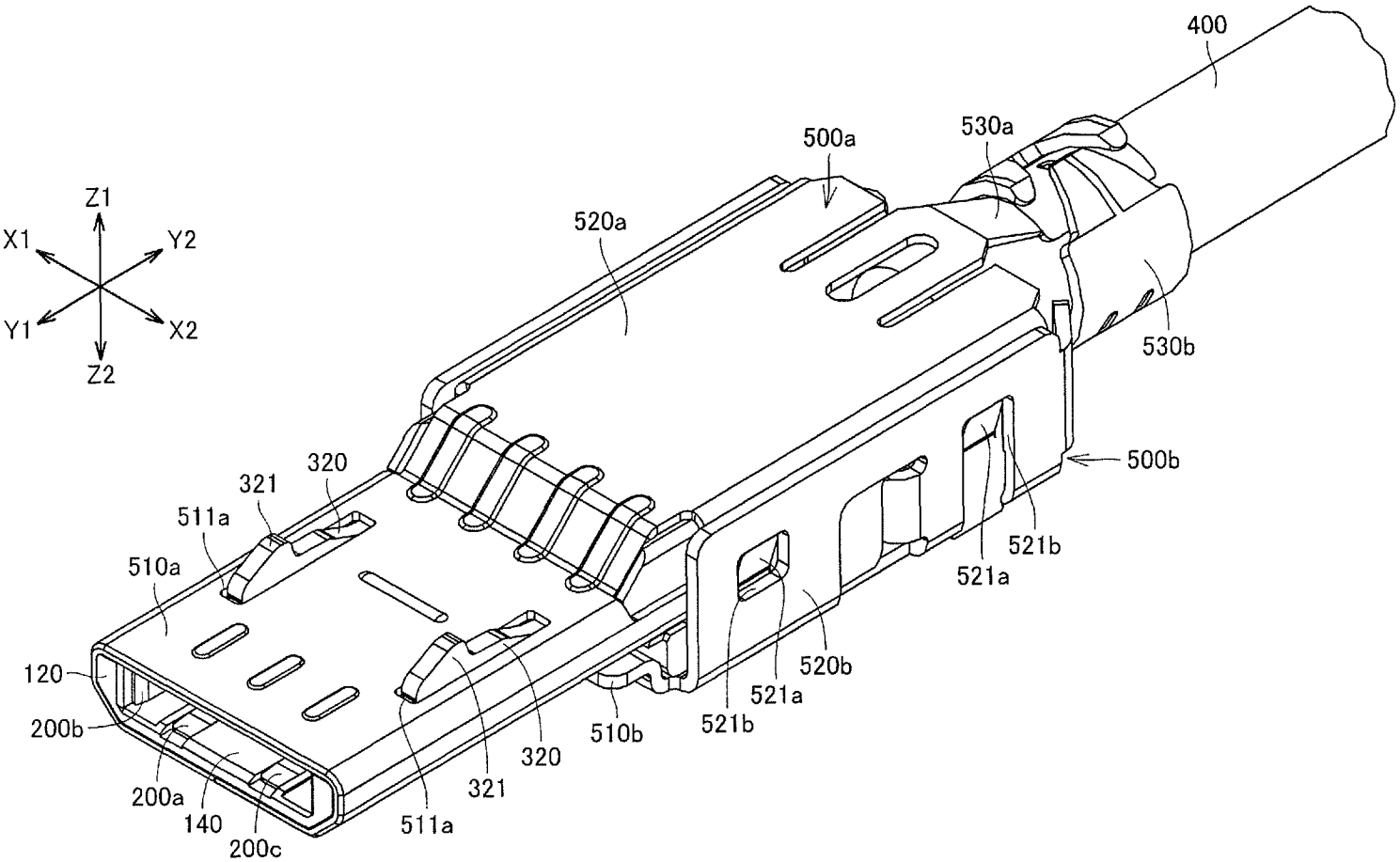
FIG. 3A is a perspective view of a body, terminals, lock pieces, a cable, and a shield case of the connector as viewed from the front, top, right side.
Figure 3B:
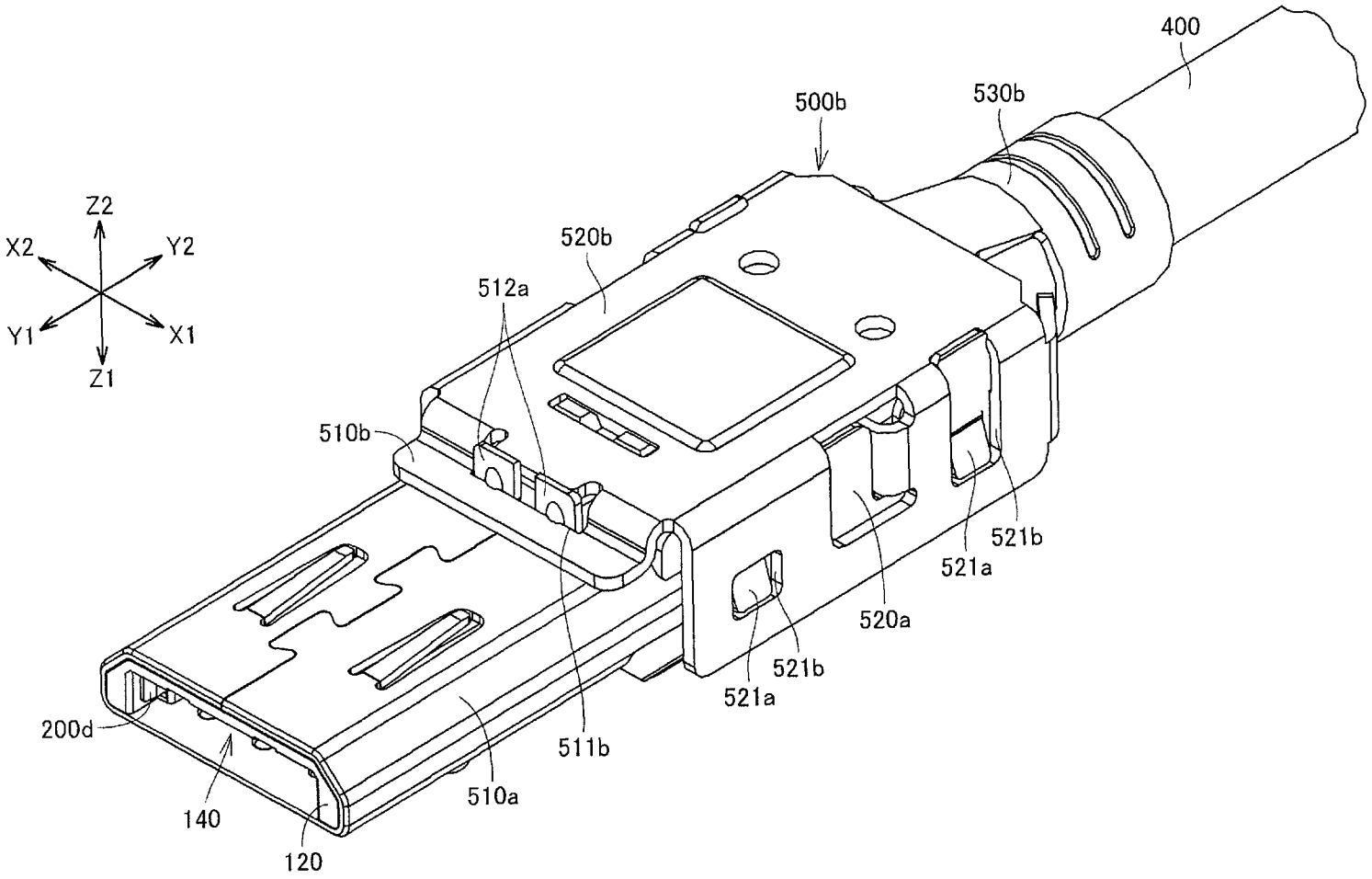
FIG. 3B is a perspective view of the body, the terminals, the lock pieces, the cable, and the shield case of the connector as viewed from the front, bottom, left side.

The tongue 510*b* is contiguous with the Y1-direction end of the cup 520*b*. As shown in FIG. 3B, the tongue 510*b* has a slit 511*b*. The slit 511*b* is engaged with the engaging pieces 512*a* of the tube 510*a*.

The cable holder 530*b* is a plate contiguous with the Y2-direction end of the cup 520*b* and extends in the Y2 direction. The distal portion of the cable holder 530*b* is curved like a ring to hold the distal portion of the cable holder 530*a* and the insulator 420 of the cable 400.

The case 600 as shown in FIG. 1 is made of insulating resin and covers the base 110 of the body 100, the cup 520*a* and the cable holder 530*a* of the shield case 500*a*, the shield case 500*b*, and one lengthwise end of the cable 400. In other words, the tube 510*a* of the shield case 500*a* and the protruding part 120 of the body 100 protrude from the case 600 in the Y1 direction. The remaining portion of the cable 400 is led out of the case 600 to the Y2 direction.

The connector P may be assembled in the following manner. First, the body 100 and the second and fourth terminals 200*b* and 200*d* are prepared. The second connecting portion 240*b* and the second engaging portion 220*b* of the second terminal 200*b* are inserted into the engaging hole 152*b* of the body 100 from the Y1 direction. The inserted second connecting portion 240*b* fits into the L-shaped recess 151*b* of the first recess 130*a* of the body 100. The second connecting portion 240*b* is thus embedded in the first bottom 131*a* and the first side wall 132*a* of the first recess 130*a* and partially exposed from the first bottom 131*a* and the first side wall 132*a*. The inserted second engaging portion 220*b* is engaged with the engaging hole 152*b*. The second extended portion 230*b* of the second terminal 200*b* is received in the slit 153*b* of the body 100 and extends along the wall on the Y2-direction side of the housing recess 154*b* of the body 100. The second contact portion 210*b* of the second terminal 200*b* is disposed along the wall on the X1-direction side of the housing recess 154*b*. The second terminal 200*b* is thus held by the body 100.

Similarly, the fourth connecting portion 240*d* and the fourth engaging portion 220*d* of the fourth terminal 200*d* are inserted into the engaging hole 152*d* of the body 100 from the Y1 direction. The inserted fourth connecting portion 240*d* fits into the L-shaped recess 151*d* of the second recess 130*b* of the body 100. The fourth connecting portion 240*d* is thus embedded in the second bottom 131*b* and the second side wall 132*b* of the second recess 130*b* and partially exposed from the second bottom 131*b* and the second side wall 132*b*. The inserted fourth engaging portion 220*d* is engaged with the engaging hole 152*d*. The fourth extended portion 230*d* of the fourth terminal 200*d* is received in the slit 153*d* of the body 100 and extends along the wall on the Y2-direction side of the housing recess 154*d* of the body 100. The fourth contact portion 210*d* of the fourth terminal 200*d* is disposed along the wall on the X2-direction side of the housing recess 154*d*. The fourth terminal 200*d* is thus held by the body 100.

The first and third terminals 200*a* and 200*c* are also prepared. The first contact portion 210*a* and the first engaging portion 220*a* of the first terminal 200*a* are inserted into the engaging hole 151*a* of the body 100 from the Y2 direction. The inserted first contact portion 210*a* is received in the groove 152*a* of the body 100 and partially exposed to the connection part 140. The inserted first engaging portion 220*a* is engaged with the engaging hole 151*a*. The first bent portion 230*a* of the first terminal 200*a* is housed in the first recess 130*a* of the body 100. The first connecting portion 240*a* of the first terminal 200*a* is disposed on the second connecting portion 240*b* of the second terminal 200*b* in the first recess 130*a* to be brought into contact with the second portion 242*b* of the second connecting portion 240*b*. The second portion 242*b* is exposed from the first and second cut-outs of the first connecting portion 240*a*.

Similarly, the third contact portion 210*c* and the third engaging portion 220*c* of the third terminal 200*c* are inserted into the engaging hole 151*c* of the body 100 from the Y2 direction. The inserted third contact portion 210*c* is received in the groove 152*c* of the body 100, and is exposed to the connection part 140. The inserted third engaging portion 220*c* is engaged with the engaging hole 151*c*. The third bent portion 230*c* of the third terminal 200*c* is housed in the second recess 130*b* of the body 100. The third connecting portion 240*c* of the third terminal 200*c* is disposed on the fourth connecting portion 240*d* of the fourth terminal 200*d* in the second recess 130*b* to be brought into contact with the second portion 242*d* of the fourth connecting portion 240*d*. The second portion 242*d* is exposed from the first and second cut-outs of the third connecting portion 240*c*.

The cable 400 is also prepared. The first core wire 410*a* of the cable 400 is inserted into the first recess 130*a* of the body 100 to be brought into contact with the first and second connecting portions 240*a* and 240*b*. Similarly, the second core wire 410*b* of the cable 400 is inserted into the second recess 130*b* of the body 100 to be brought into contact with the third and fourth connecting portions 240*c* and 240*d*. In this state, the first core wire 410*a* is soldered to the first and second connecting portions 240*a* and 240*b*, and the second core wire 410*b* is soldered to the third and fourth connecting portions 240*c* and 240*d*.

The lock pieces 300 are also prepared. The arms 320 and the fixing portions 310 of the lock pieces 300 are inserted into the respective engaging holes 161 of the body 100. The inserted fixing portions 310 are brought into engagement with the engaging holes 161. The abutting portions 330 of the lock pieces 300 are brought into abutment with the body 100. The arms 320 are received in the respective slits 162 of the body 100, and the claws 321 of the arms 320 protrude from the respective slits 162 in the Z1 direction.

The shield cases 500*a* and 500*b* and the insulating tape 700 are also prepared. The cable holder 530*b* of the shield case 500*b* is a flat plate at this stage. Subsequently, the protruding part 120 of the body 100 is inserted into the tube 510*a* of the shield case 500*a*, and the cup 520*a* of the shield case 500*a* is placed over the base 110 of the body 100. At this stage, the cable holder 530*a* of the shield case 500*a* contacts the insulator 420 of the cable 400. The claws 321 of the lock pieces 300 are received in the respective openings 511*a* of the tube 510*a*.

Then, the insulating tape 700 is placed on the body 100 to close the first and second recesses 130*a* and 130*b*. After that, the engaging pieces 512*a* of the tube 510*a* is inserted into and brought into engagement with the slit 511*b* of the tongue 510*b* of the shield case 500*b*. Simultaneously, the cup 520*b* of the shield case 500*b* is placed over the cup 520*a* to engage the engaging pieces 521*a* of the cup 520*a* with the respective engaging holes 521*b* of the cup 520*b*. Also, the cup 520*b* contacts the insulating tape 700, and the cable holder 530*b* contacts the insulator 420 of the cable 400. The shield cases 500*a* and 500*b* are thus combined to cover the body 100. After that, the cable holder 530*b* is curved like a ring to hold the cable 400 and the cable holder 530*a*. The shield cases 500*a* and 500*b* thus hold the cable 400.

Subsequently, the base 110 of the body 100, the cup 520*a* of the shield case 500*a*, the cable holder 530*a*, the shield case 500*b*, and the lengthwise end of the cable 400 are placed into a die. Into the die, insulating resin is injected to mold the case 600. The case 600 thus covers the base 110 of the body 100, the cup 520*a* of the shield case 500*a*, the cable holder 530*a*, the shield case 500*b*, and the lengthwise end of the cable 400.

The connector P described above has at least the following technical features. First, the connector P will not be substantially upsized in accordance with the increase in outer diameter of the first and second core wires 410*a* and 410*b* for the purpose of supplying a large amount of power. This is realized through the following arrangement. The second connecting portion 240*b* is provided in the first bottom 131*a* and the first side wall 132*a* of the first recess 130*a*, and the first connecting portion 240*a* is provided on the second portion 242*b* of the second connecting portion 240*b*. The fourth connecting portion 240*d* is provided in the second bottom 131*b* and the second side wall 132*b* of the second recess 130*b*, and the third connecting portion 240*c* is provided on the second portion 242*d* of the fourth connecting portion 240*d*. The first core wire 410*a* is connected to the first and second connecting portions 240*a* and 240*b* together in the first recess 130*a*. The second core wire 410*b* is connected to the third and fourth connecting portions 240*c* and 240*d* together in the second recess 130*b*. This arrangement can reduce connection spaces (soldering spaces) for connecting between the first core wire 410*a* and the first and second connecting portions 240*a* and 240*b* and for connecting between the second core wire 410*b* and the third and fourth connecting portions 240*c* and 240*d*.

Second, the connector P has improved reliability of connection between the first core wire 410*a* and the first and second terminals 200*a* and 200*b* for the reasons below. The first portion 241*b* of the second connecting portion 240*b* is provided in the first side wall 132*a* of the first recess 130*a*, and the second portion 242*b* of the second connecting portion 240*b* is provided in the first bottom 131*a* of the first recess 130*a*. The second portion 242*b* is in contact with the first connecting portion 240*a*. The first connecting portion 240*a* has smaller outer dimensions than the second portion 242*b*, so that the second portion 242*b* is partially exposed outside the first connecting portion 240*a*. This arrangement can increase the area for connection between the first core wire 410*a* and the first and second connecting portions 240*a* and 240*b*. Therefore, connecting the first core wire 410*a* to at least one of the first and second connecting portions 240*a* and 240*b* will result in connection to both the connecting portions. Similarly, the connector P has an improved reliability of connection between the second core wire 410*b* and the third and fourth terminals 200*c* and 200*d* for the reasons below. The first portion 241*d* of the fourth connecting portion 240*d* is provided in the second side wall 132*b* of the second recess 130*b*, and the second portion 242*d* of the fourth connecting portion 240*d* is provided in the second bottom 131*b* of the second recess 130*b*. The second portion 242*d* is in contact with the third connecting portion 240*c*. The third connecting portion 240*c* has smaller outer dimensions than the second portion 242*d*, so that the second portion 242*d* is partially exposed outside the third connecting portion 240*c*. This arrangement can increase the area for connection between the second core wire 410*b* and the third and fourth connecting portions 240*c* and 240*d*. Therefore, connecting t the second core wire 410*b* to at least one of the third and fourth connecting portions 240*c* and 240*d* will result in connection to both the connecting portions.

Third, the connector P has an improved reliability of connection with respect to a mating connector R (to be described) for the reasons below. The first and third contact portions 210*a* and 210*c* of the first and third terminals 200*a* and 200*c* are respectively received in the grooves 152*a* and 152*c* in the bottom of the connection part 140. The second contact portion 210*b* of the second terminal 200*b* is disposed along the wall on the X1-direction side of the housing recess 154*b* of the connection part 140. The fourth contact portion 210*d* of the fourth terminal 200*d* is disposed along the wall on the X2-direction side of the housing recess 154*d* of the connection part 140. This means that the first and third contact portions 210*a* and 210*c*, and the second and fourth contact portions 210*b* and 210*d* are exposed from different places of the connection part 140. Therefore, even if the connector P is pried with its connection hole engaged with the mating connector R, it is still possible to maintain the electrical connection of the mating connector R to at least one of the first and second contact portions 210*a* and 210*b* and to at least one of the third and fourth contact portions 210*c* and 210*d*.

Fourth, the connector P can be readily modified and therefore has improved versatility. One of the first and second terminals 200*a* and 200*b* can be omitted because the first core wire 410*a* is still connected to the other of the first and second terminals 200*a* and 200*b* in the first recess 130*a*. One of the third and fourth terminals 200*c* and 200*d* can be omitted because the second core wire 410*b* is still connected to the other of the third and fourth terminals 200*c* and 200*d* in the second recess 130*b*. It is thus easy to modify the connector P, simply by omitting one of the first and second terminals 200*a* and 200*b* and one of the third and fourth terminals 200*c* and 200*d*.

The mating connector R in accordance with an embodiment of the invention will be described below with reference to FIG. 8A to FIG. 12B. The mating connector R is a receptacle connector. The mating connector R includes a body 10, signal terminals 20*a* and 20*b*, a ground terminal 20*c*, signal terminals 20*d* and 20*e*, first, second, third, and fourth power terminals 30*a*, 30*b*, 30*c*, and 30*d*, and a shield case 40. These constituents of the mating connector R will be described below in detail. X1' in FIG. 8A to FIG. 12B represents a widthwise direction of the mating connector R, and X2' represents the other widthwise direction of the mating connector R. Y1' represents a lengthwise direction of the mating connector R, and Y2' represents the other lengthwise direction of the mating connector R. Z1' represents a heightwise direction of the mating connector R, and Z2' represents the other heightwise direction of the mating connector R. The Y1'-Y2' direction is orthogonal to the X1'-X2' direction, and the Z1'-Z2' direction is orthogonal to the X1'-X2' direction and the Y1'-Y2' direction.

The body 10 as shown in FIG. 8A to FIG. 11B is made of insulating resin. The body 10 includes a base 11, a first protruding part 12, a second protruding part 13, housing portions 14*a*, 14*b*, 14*c*, 14*d*, and 14*e*, and housing portions 15*a*, 15*b*, 15*c*, and 15*d*.

As shown in FIG. 8A to FIG. 11B, the base 11 is a block made of insulating resin. The first protruding part 12 is an insulating resin block extending from the Z1'-Z2' direction center of the Y1'-direction end of the base 11. The first protruding part 12 is smaller in the X1'-X2' direction than the base 11, and the first protruding part 12 is smaller in the Z1'-Z2' direction than the base 11. The second protruding part 13 is an insulating resin block provided at the Y1'-direction end of the first protruding part 12. The second protruding part 13 is smaller in the X1'-X2' direction than the first protruding part 12, and the second protruding part 13 is smaller in the Z1'-Z2' direction than the first protruding part 12. The first and second protruding parts 12 and 13 has outer shapes conforming to the connection hole of the connector P, so that the first and second protruding parts 12 and 13 can be removably received in the connection hole of the connector P.

The housing portion 14*a* has an engaging hole 14*a*1, a housing groove 14*a*2, and a housing groove 14*a*3. The housing portion 14*b* has an engaging hole 14*b*1, a housing groove 14*b*2, and a housing groove 14*b*3. The housing portion 14*c* has an engaging hole 14*c*1, a housing groove 14*c*2, and a housing groove 14*c*3. The housing portion 14*d* has an engaging hole 14*d*1, a housing groove 14*d*2, and a housing groove 14*d*3. The housing portion 14*e* has an engaging hole 14*e*1, a housing groove 14*e*2, and a housing groove 14*e*3.

Figure 9A:
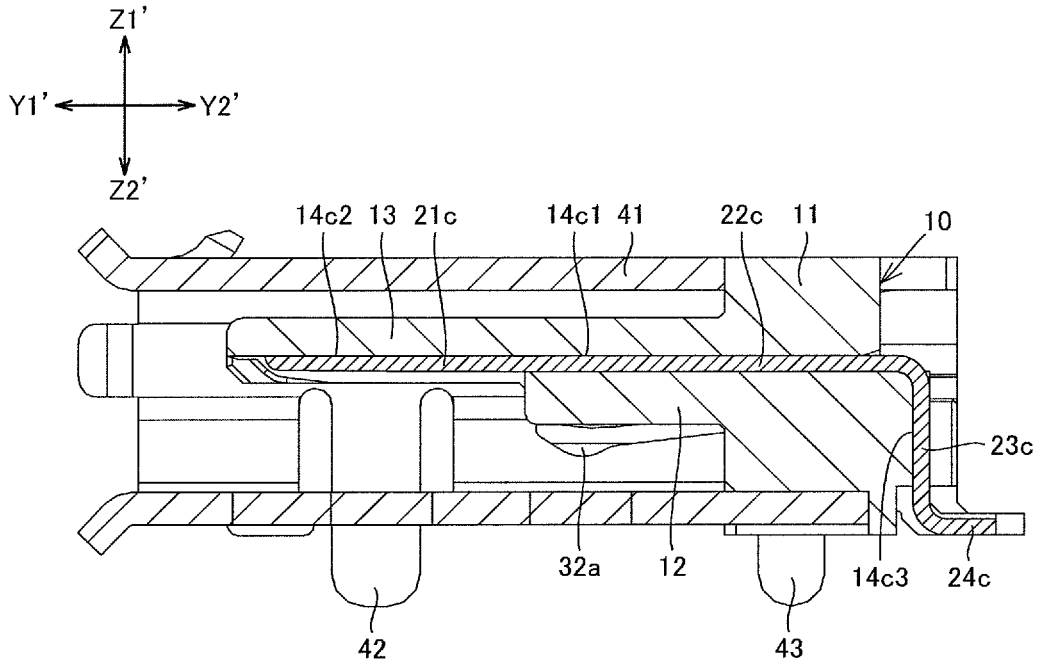
FIG. 9A is a sectional view of the mating connector taken along 9A-9A in FIG. 8A.
Figure 9B:
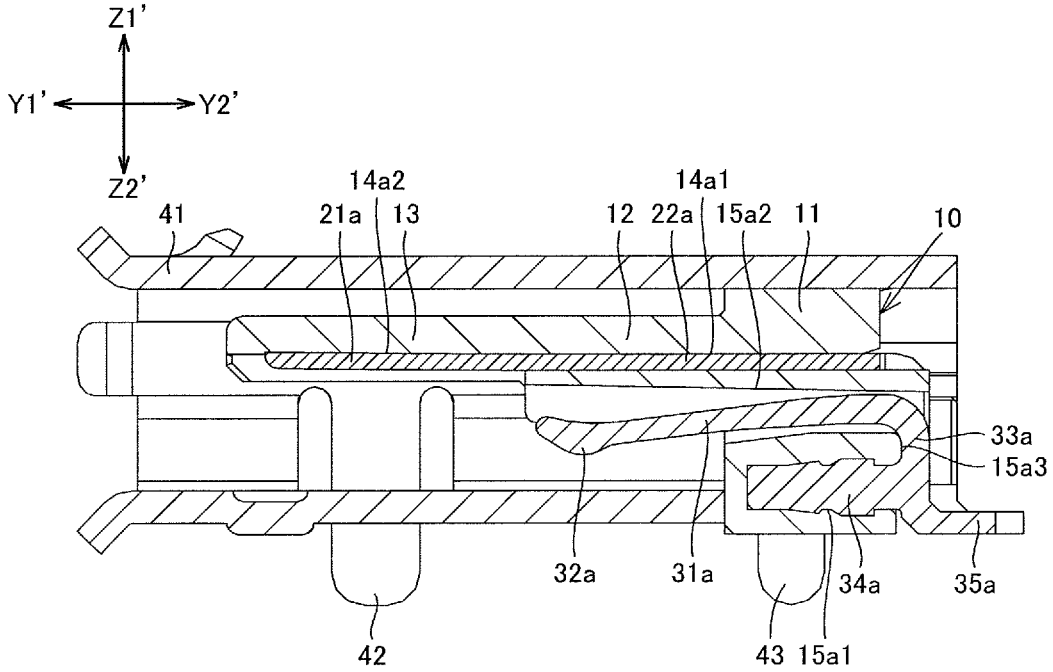
FIG. 9B is a sectional view of the mating connector taken along 9B-9B in FIG. 8A.
Figure 10A:
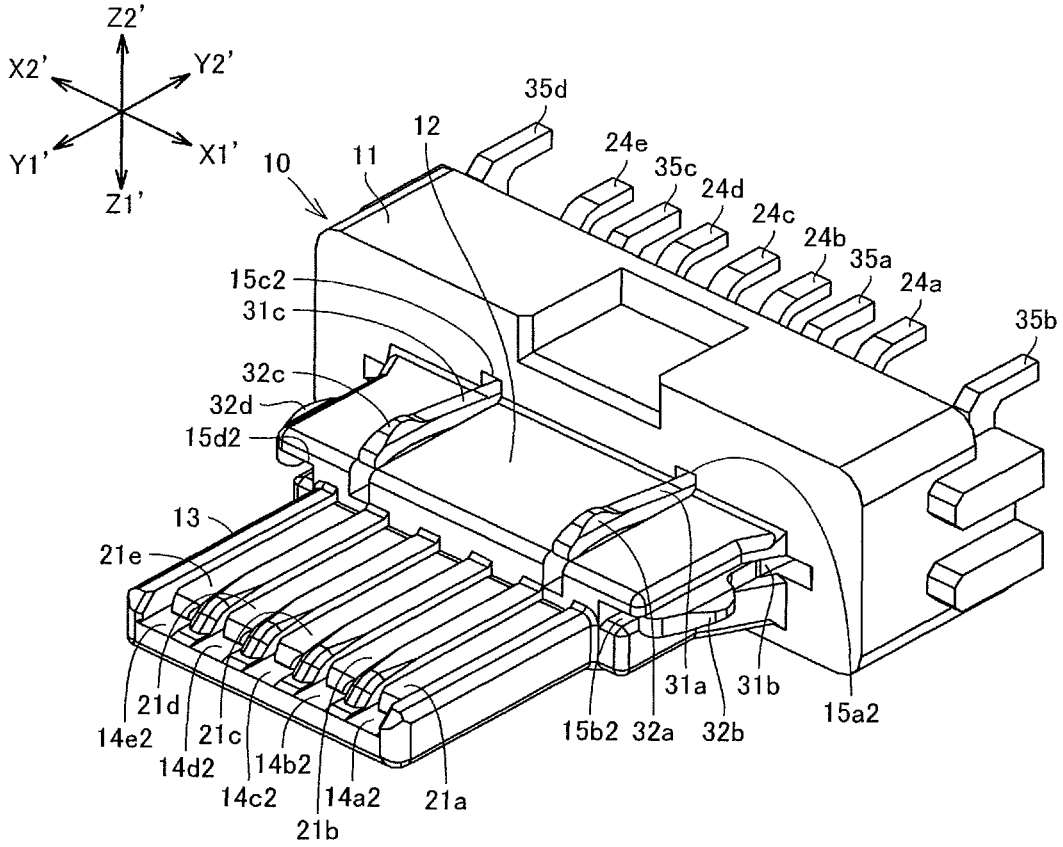
FIG. 10A is a perspective view of a body, signal terminals, and power terminals of the mating connector as viewed from the front, bottom, left side.
Figure 10B:
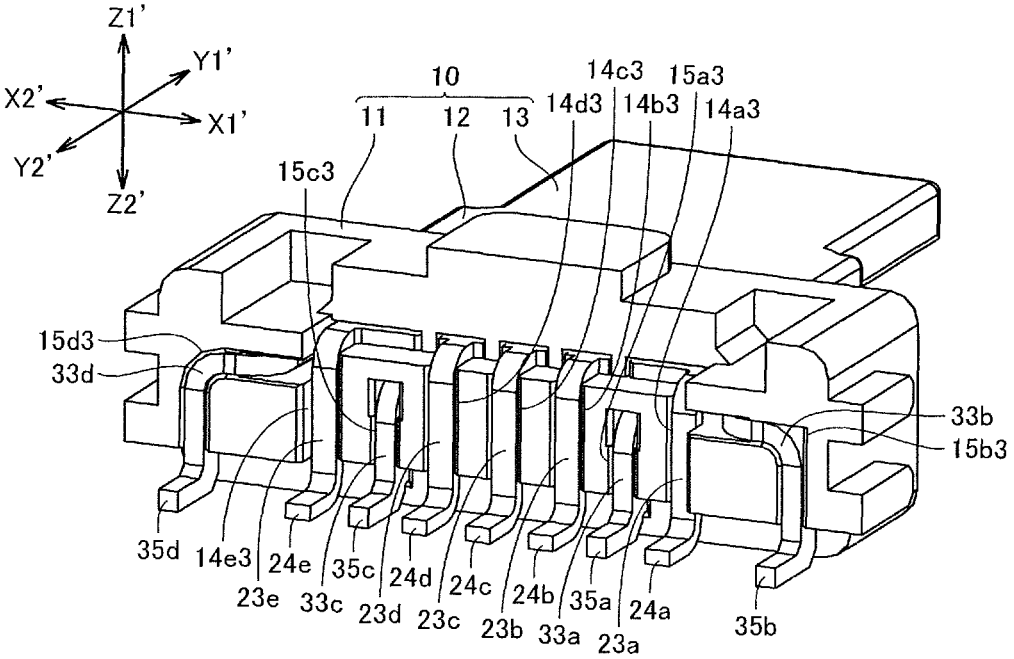
FIG. 10B is a perspective view of the body, the signal terminals, and the power terminals of the mating connector as viewed from the back, top, left side.
Figure 11A:
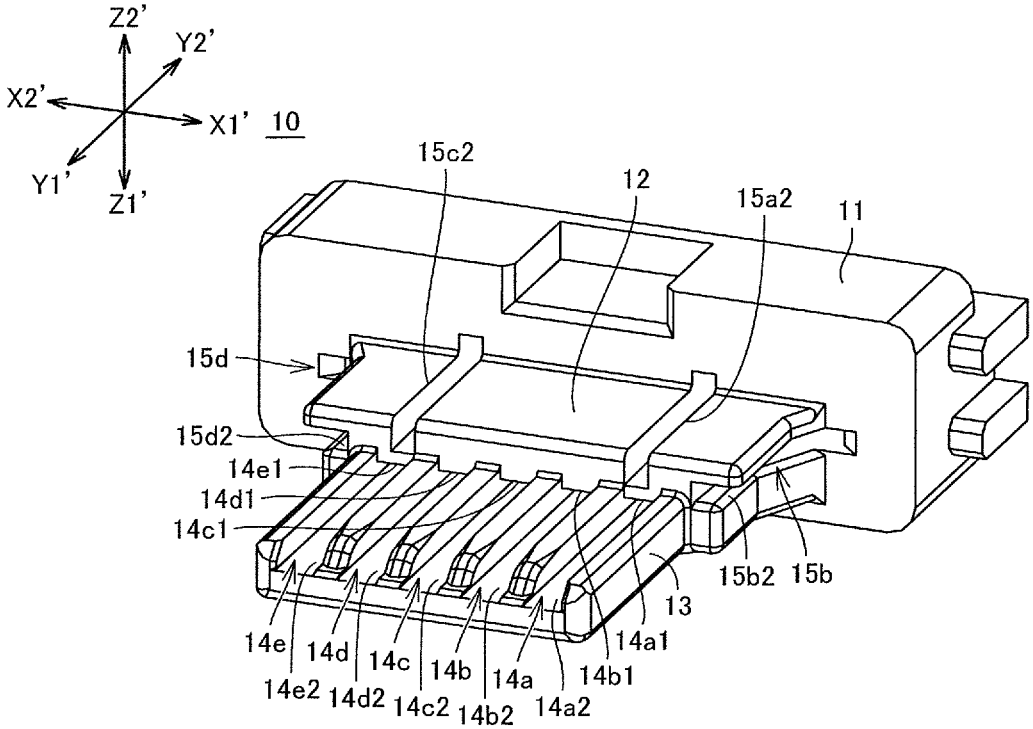
FIG. 11A is perspective view of the body of the mating connector as viewed from the front, bottom, left side.
Figure 11B:
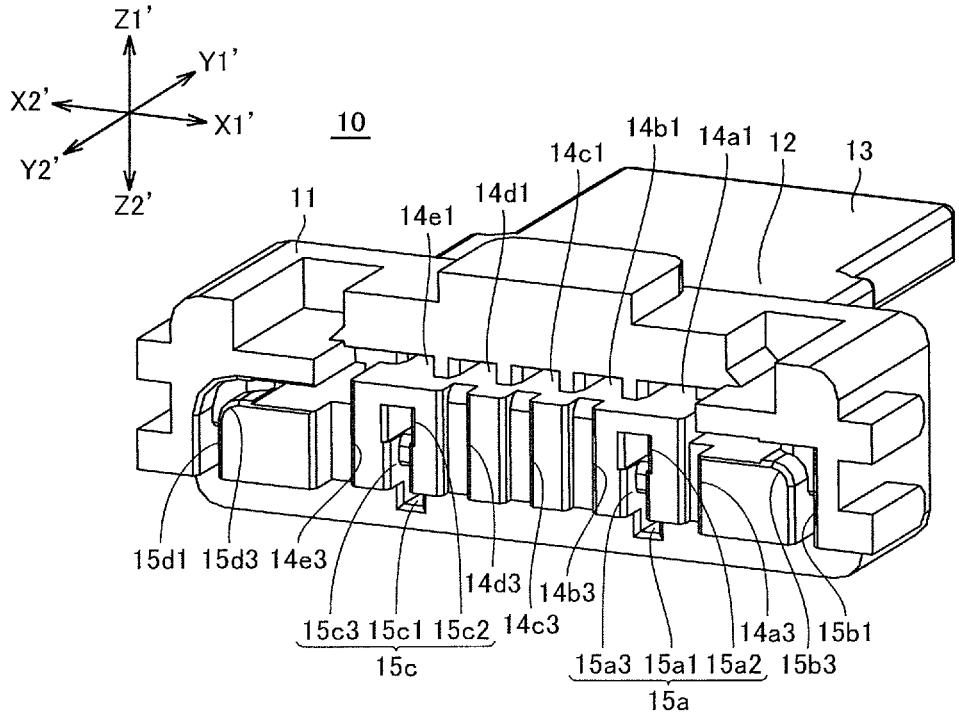
FIG. 11B is a perspective view of the body of the mating connector as viewed from the back, top, and left side.

As shown in FIG. 10A to FIG. 11B, the engaging holes 14*a*1 to 14*e*1 are provided in the base 11 and the first protruding part 12 at intervals in the X1'-X2' direction. The engaging hole 14*a*1 to 14*e*1 extend through the base 11 and the first protruding part 12 in the Y1'-Y2' direction (see FIG. 9A and FIG. 9B). As shown in FIG. 10A and FIG. 11A, the housing grooves 14*a*2 to 14*e*2 are provided in the Z2'-direction end face of the second protruding part 13 at the same intervals in the X1'-X2' direction as those of the engaging holes 14*a*1 to 14*e*1. The housing grooves 14*a*2 to 14*e*2 extend in the Y1'-Y2' direction and communicate with the engaging hole 14*a*1 to 14*e*1, respectively. As shown in FIG. 11B, the housing grooves 14*b*3 to 14*d*3 are provided in the Y2'-direction end face of the base 11, at positions on the Z2'-direction side (on the lower side) of the engaging hole 14*b*1 to 14*d*1. The housing grooves 14*b*3 to 14*d*3 extend in the Z1'-Z2' direction. The housing grooves 14*a*3 and 14*e*3 each consist of a horizontal groove extending in the X1'-X2' direction and a vertical groove extending in the Z1'-Z2' direction. The horizontal groove of the housing groove 14*a*3 communicates with the engaging hole 14*a*1, and the horizontal groove of the housing groove 14*e*3 communicates with the engaging hole 14*e*1. The vertical groove of the housing groove 14*a*3 communicates with the X1'-direction end of the horizontal groove of the housing groove 14*a*3. The vertical groove of the housing groove 14*e*3 communicates with the XT-direction end of the horizontal groove of the housing groove 14*e*3.

As shown in FIG. 9B and FIG. 10A to FIG. 11B, the housing portion 15*a* includes an engaging hole 15*a*1, a housing portion body 15*a*2, and a housing groove 15*a*3. The housing portion body 15*a*2 consists of a receiving hole and a receiving groove. The receiving hole of the housing portion body 15*a*2 is provided at a position of the base 11 substantially corresponding to the first contact portion 210*c* of the third terminal 200*c* of the connector P. The receiving hole of the housing portion body 15*a*2 is located on the Z2'-direction side than the engaging hole 14*a*1 of the housing portion 14*a*. As shown in FIG. 9B, the receiving hole of the housing portion body 15*a*2 extends through the base 11 in the Y1'-Y2' direction. As shown in FIG. 9B, FIG. 10A, and FIG. 11A, the receiving groove of the housing portion body 15*a*2 is provided in the Z2'-direction end face of the first protruding part 12 and communicates with the receiving hole. The receiving groove of the housing portion body 15*a*2 extends in the Y1'-Y2' direction. This means that the receiving groove of the housing portion body 15*a*2 is located at a position substantially corresponding to the first contact portion 210*c* of the third terminal 200*c* of the connector P. As shown in FIG. 9B and FIG. 11B, the engaging hole 15*a*1 is provided at a position of the base 11, on the Z2'-direction side of the receiving hole of the housing portion body 15*a*2. The engaging hole 15*a*1 extends in the Y1'-Y2' direction. As shown in FIG. 9B, FIG. 10B, and FIG. 11B, the housing groove 15*a*3 is provided in the Y2'-direction end face of the base 11. The housing groove 15*a*3 is located between the vertical groove of the housing groove 14*a*3 of the housing portion 14*a* and the housing groove 14*b*3 of the housing portion 14*b*. The housing groove 15*a*3 extends in the Z1'-Z2' direction and communicates with the receiving hole of the housing portion body 15*a*2 and the engaging hole 15*a*1.

As shown in FIG. 10A to FIG. 11B, the housing portion 15*c* has substantially the same shape as the housing portion 15*a*, but it is disposed at a different position as described below. A receiving hole of a housing portion body 15*c*2 of the housing portion 15*c* is provided at a position of the base 11 substantially corresponding to the first contact portion 210*a* of the first terminal 200*a* of the connector P. The receiving hole of the housing portion body 15*c*2 is located on the Z2'-direction side of the engaging hole 14*e*1 of the housing portion 14*e*. The receiving groove of the housing portion body 15*c*2 is provided in the Z2'-direction end face of the first protruding part 12 and communicates with the receiving hole. This means that the receiving groove of the housing portion body 15*c*2 is also located at a position substantially corresponding to the first contact portion 210*a* of the first terminal 200*a*. As shown in FIG. 11B, an engaging hole 15*c*1 of the housing portion 15*c* is provided at a position of the base 11, on the Z2'-direction side of the housing groove of the housing portion body 15*c*2. A housing groove 15*c*3 of the housing portion 15*c* is located between the vertical groove of the housing groove 14*e*3 of the housing portion 14*e* and the housing groove 14*d*3 of the housing portion 14*d*. The housing groove 15*c*3 of the housing portion 15*c* communicates with the receiving hole of the housing portion body 15*c*2 and the engaging hole 15*c*1.

As shown in FIG. 9C and FIG. 10A to FIG. 11B, the housing portion 15*b* includes an engaging hole 15*b*1, a housing portion body 15*b*2, and a housing groove 15*b*3. The housing portion body 15*b*2 has a receiving hole and a receiving groove. The receiving hole of the housing portion body 15*b*2 is provided in the base 11, located on the X1'-direction side of the first protruding part 12. The receiving hole of the housing portion body 15*b*2 extends through the base 11 in the Y1'-Y2' direction. As shown in FIG. 10A and FIG. 11A, the receiving groove of the housing portion body 15*b*2 is provided in the X1'-direction end face of the first protruding part 12 and communicates with the receiving hole. The receiving groove of the housing portion body 15*b*2 extends in the Y1'-Y2' direction. The receiving groove of the housing portion body 15*b*2 is located at a position substantially corresponding to the fourth contact portion 210*d* of the fourth terminal 200*d*. As shown in FIG. 10B and FIG. 11B, the housing groove

15*b*3 consists of a horizontal groove and a vertical groove. The horizontal groove communicates with the receiving hole of the housing portion body 15*b*2 and extends in the X1' direction. The vertical groove communicates with the X1'-direction end of the horizontal groove and extends in the Z2' direction. As shown in FIG. 11B, the engaging hole 15*b*1 extends in the Y1' direction from the Z2'-direction end of the housing groove 15*b*3. The engaging hole 15*b*1 communicates with the housing groove 15*b*3.

As shown in FIG. 10A to FIG. 11B, since the housing portion 15*d* is symmetric to the housing portion 15*b*, only the differences between them will be described. A receiving hole of a housing portion body 15*d*2 is provided in the base 11, located on the X2'-direction side of the first protruding part 12. As shown in FIG. 10A and FIG. 11A, an receiving groove of the housing portion body 15*d*2 is provided in the X2'-direction end face of the first protruding part 12 and communicates with the receiving hole. The receiving groove of the housing portion body 15*d*2 is located at a position substantially corresponding to the second contact portion 210*b* of the second terminal 200*b*. As shown in FIG. 10B and FIG. 11B, a housing groove 15*d*3 consists of a horizontal groove and a vertical groove. The horizontal groove communicates with the receiving hole of the housing portion body 15*d*2 and extends in the X2' direction. The vertical groove communicates with the X2'-direction end of the horizontal groove and extends in the Z2' direction. As shown in FIG. 11B, an engaging hole 15*d*1 extends in the Y1' direction from the Z2'-direction end of the housing groove 15*d*3. The engaging hole 15*d*1 communicates with the housing groove 15*d*3.

The signal terminal 20*a* as shown in FIG. 9B, FIG. 10A to FIG. 10B, and FIG. 12A to FIG. 12B is formed of a metal plate. The signal terminal 20*a* includes a contact portion 21*a*, an engaging portion 22*a*, an L-shaped portion 23*a*, and a tail portion 24*a*. The engaging portion 22*a* is a metal plate extending in the Y1'-Y2' direction and is received in and engaged with the engaging hole 14*a*1 of the housing portion 14*a*. The contact portion 21*a* is a metal plate extending in the Y1' direction from the Y1'-direction end of the engaging portion 22*a*. The contact portion 21*a* is received in the housing groove 14*a*2 of the housing portion 14*a*. The L-shaped portion 23*a* consists of a horizontal portion and a hanging portion. The horizontal portion is a metal plate extending in the X1' direction from the Y2'-direction end of the engaging portion 22*a*. The horizontal portion is housed in the horizontal groove of the housing groove 14*a*3 of the housing portion 14*a*. The hanging portion is a metal plate extending in the Z2' direction from the X1'-direction end of the horizontal portion. The hanging portion is housed in the vertical groove of the housing groove 14*a*3. The tail portion 24*a* is a metal plate extending in the Y2' direction from the Z2'-direction end of the hanging portion.

The signal terminal 20*e* as shown in FIG. 10A to FIG. 10B and FIG. 12A to FIG. 12B is formed of a metal plate. Since the signal terminal 20*e* is symmetric to the signal terminal 20*a*, only the differences between them will be described. An engaging portion 22*e* of the signal terminal 20*e* is received in and engaged with the engaging hole 14*e*1 of the housing portion 14*e*. A contact portion 21*e* of the signal terminal 20*e* is received in the housing groove 14*e*2 of the housing portion 14*e*. A horizontal portion of an L-shaped portion 23*e* of the signal terminal 20*e* is a metal plate extending in the X2' direction from the Y2'-direction end of the engaging portion 22*e*. The horizontal portion is housed in the horizontal groove of the housing groove 14*e*3 of the housing portion 14*e*. The hanging portion of the L-shaped portion 23*e* is a metal plate extending in the Z2' direction from the X2'-direction end of the horizontal portion. The hanging portion is housed in the vertical groove of the housing groove 14*e*3. The signal terminal 20*e* also includes a tail portion 24*e* as illustrated in FIG. 10A to FIG. 10B and FIG. 12A to FIG. 12B.

The signal terminal 20*b* as shown in FIG. 10A to FIG. 10B and FIG. 12A to FIG. 12B is formed of a metal plate. The signal terminal 20*b* includes a contact portion 21*b*, an engaging portion 22*b*, a hanging portion 23*b*, and a tail portion 24*b*. The engaging portion 22*b* is a metal plate extending in the Y1'-Y2' direction and is received in and engaged with the engaging hole 14*b*1 of the housing portion 14*b*. The contact portion 21*b* is a metal plate extending in the Y1' direction from the Y1'-direction end of the engaging portion 22*b*. The contact portion 21*b* is received in the housing groove 14*b*2 of the housing portion 14*b*. The hanging portion 23*b* is a metal plate extending in the Z2' direction from the Y2'-direction end of the engaging portion 22*b*. The hanging portion 23*b* is housed in the housing groove 14*b*3 of the housing portion 14*b*. The tail portion 24*b* is a metal plate extending in the Y2' direction from the Z2'-direction end of the hanging portion 23*b*. It should be noted that the signal terminals 20*a* and 20*b* constitute a differential pair.

The signal terminal 20*d* as shown in FIG. 10A to FIG. 10B and FIG. 12A to FIG. 12B is formed of a metal plate. Since the signal terminal 20*d* is of the same shape as the signal terminal 20*b*, only the differences between them will be described. A engaging portion 22*b* of the signal terminal 20*d* is received in and engaged with the engaging hole 14*d*1 of the housing portion 14*d*. A contact portion 21*d* of the signal terminal 20*d* is received in the housing groove 14*d*2 of the housing portion 14*d*. A hanging portion 23*d* of the signal terminal 20*d* is housed in the housing groove 14*d*3 of the housing portion 14*d*. The signal terminal 20*d* also includes a tail portion 24*d* as illustrated in FIG. 10A to FIG. 10B and FIG. 12A to FIG. 12B. The signal terminals 20*d* and 20*e* constitute a differential pair.

Figure 12A:
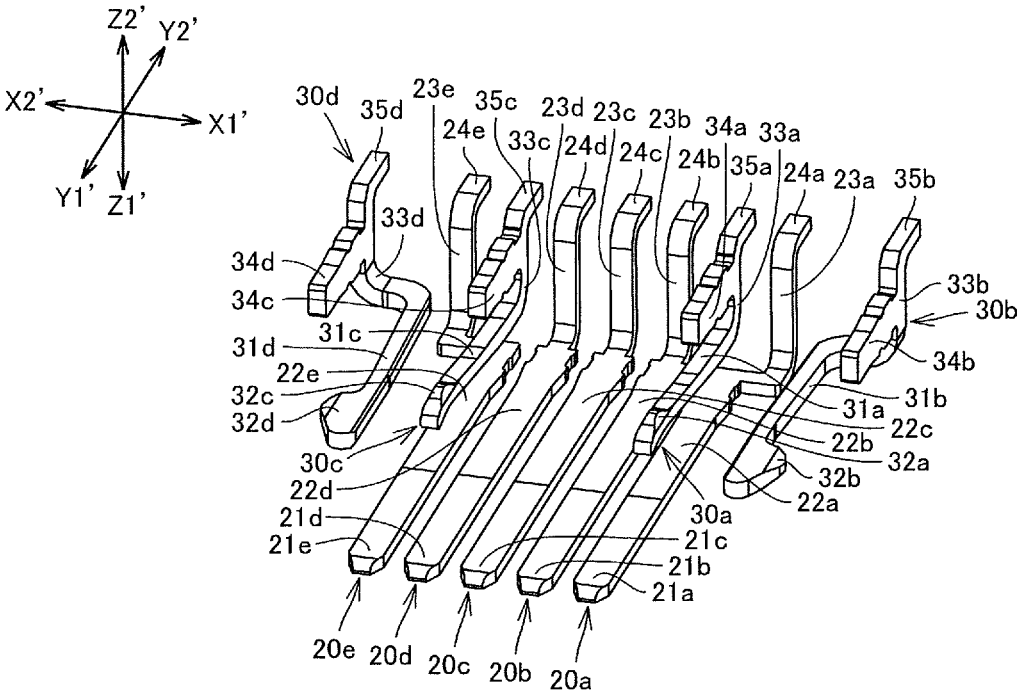
FIG. 12A is a perspective view of the signal terminals and the power terminals of the mating connector as viewed from the front, the bottom, and the left side.
Figure 12B:
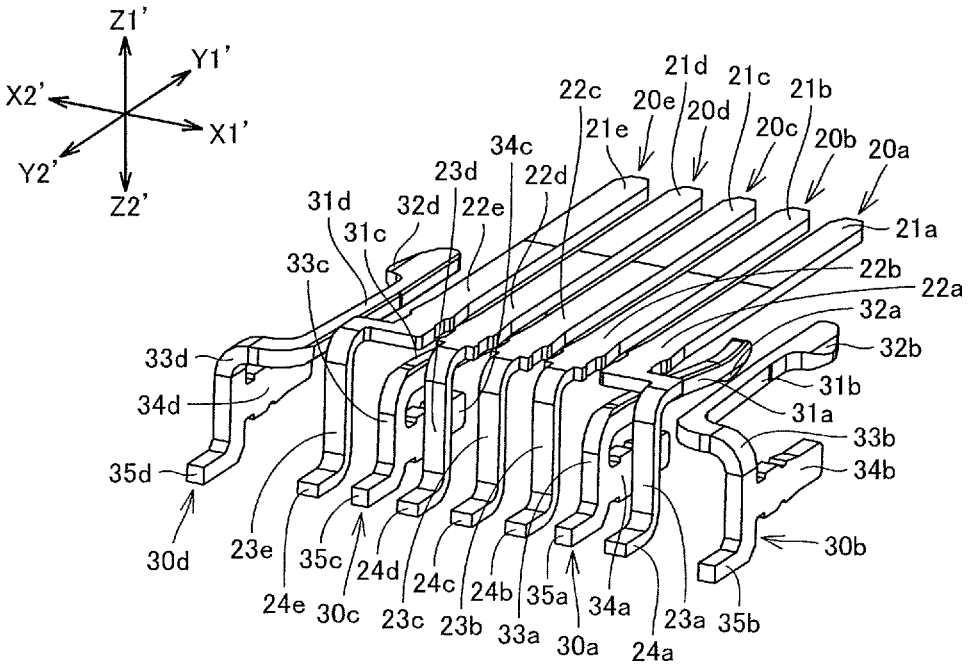
FIG. 12B is a perspective view of the signal terminals and the power terminals of the mating connector as viewed from the back, top, left side.

The ground terminal 20*c* as shown in FIG. 9A and FIG. 12A to FIG. 12B is formed of a metal plate. Since the ground terminal 20*c* is of the same shape as the signal terminal 20*b*, only the differences between them will be described. An engaging portion 22*c* of the ground terminal 20*c* is received in and engaged with the engaging hole 14*c*1 of the housing portion 14*c*. A contact portion 21*c* of the ground terminal 20*c* is received in the housing groove 14*c*2 of the housing portion 14*c*. A hanging portion 23*c* of the ground terminal 20*c* is housed in the housing groove 14*c*3 of the housing portion 14*c*. The ground terminal 20*c* also includes a tail portion 24*c* as illustrated in FIG. 9A, FIG. 10B and FIG. 12A to FIG. 12B. The ground terminal 20*c* is disposed between the signal terminal 20*b* and the signal terminal 20*d*.

The first power terminal 30*a* is a positive (Vcc) power terminal as shown in FIG. 9B and FIG. 12A to FIG. 12B. The first power terminal 30*a* is formed of a metal plate. The first power terminal 30*a* includes a first arm 31*a*, a first contact portion 32*a*, a first hanging portion 33*a*, a first engaging portion 34*a*, and a first tail portion 35*a*. The first arm 31*a* is a metal plate extending in the Y1'-Y2' direction. The first arm 31*a* is received in the housing portion body 15*a*2 of the housing portion 15*a*. The first contact portion 32*a* is a protrusion protruding in the Z2' direction at the Y1'-direction end of the first arm 31*a*. The first contact portion 32*a* protrudes in the Z2' direction out of the housing portion body 15*a*2 of the housing portion 15*a*. The first hanging portion 33*a* is a metal plate contiguous with the Y2'-direction end of the first arm 31*a* and extends in the Z2' direction. The first hanging portion 33*a* is housed in the housing groove 15*a*3 of the housing portion 15*a*. The first engaging portion 34*a* is a metal plate extending in the Y1' direction from the Z2'-direction end of the first hanging portion 33*a*. The first engaging portion 34*a* is received in and engaged with the engaging hole 15*a*1 of the housing portion 15*a*. The first tail portion 35*a* is a metal plate extending in the Y2' direction from the Z2'-direction end of the first hanging portion 33*a*. The first hanging portion 33*a* is disposed between the hanging portion of the L-shaped portion 23*a* of the signal terminal 20*a* and the hanging portion 23*b* of the signal terminal 20*b*. The first tail portion 35*a* is disposed between the tail portion 24*a* of the signal terminal 20*a* and the tail portion 24*b* of the signal terminal 20*b*. With this arrangement, the first power terminal 30*a* reduces crosstalk between the signal terminal 20*a* and the signal terminal 20*b*.

The third power terminal 30*c* is a negative (GND) power terminal as shown in FIG. 12A to FIG. 12B. The third power terminal 30*c* is formed of a metal plate. Since the third power terminal 30*c* is of the same shape as the first power terminal 30*a*, only the differences between them will be described. A third arm 31*c* of the third power terminal 30*c* is received in the housing portion body 15*c*2 of the housing portion 15*c*. A third contact portion 32*c* of the third power terminal 30*c* protrudes in the Z2' direction out of the housing portion body 15*c*2 of the housing portion 15*c*. A third hanging portion 33*c* of the third power terminal 30*c* is housed in the housing groove 15*c*3 of the housing portion 15*c*. A third engaging portion 34*c* of the third power terminal 30*c* is received in and engaged with the engaging hole 15*c*1 of the housing portion 15*c*. The third hanging portion 33*c* is disposed between the hanging portion of the L-shaped portion 23*e* of the signal terminal 20*e* and the hanging portion 23*d* of the signal terminal 20*d*. A third tail portion 35*c* of the third power terminal 30*c* is disposed between the tail portion 24*e* of the signal terminal 20*e* and the tail portion 24*d* of the signal terminal 20*d*. With this arrangement, the third power terminal 30*c* reduces crosstalk between the signal terminal 20*d* and the signal terminal 20*e*.

Figure 9C:
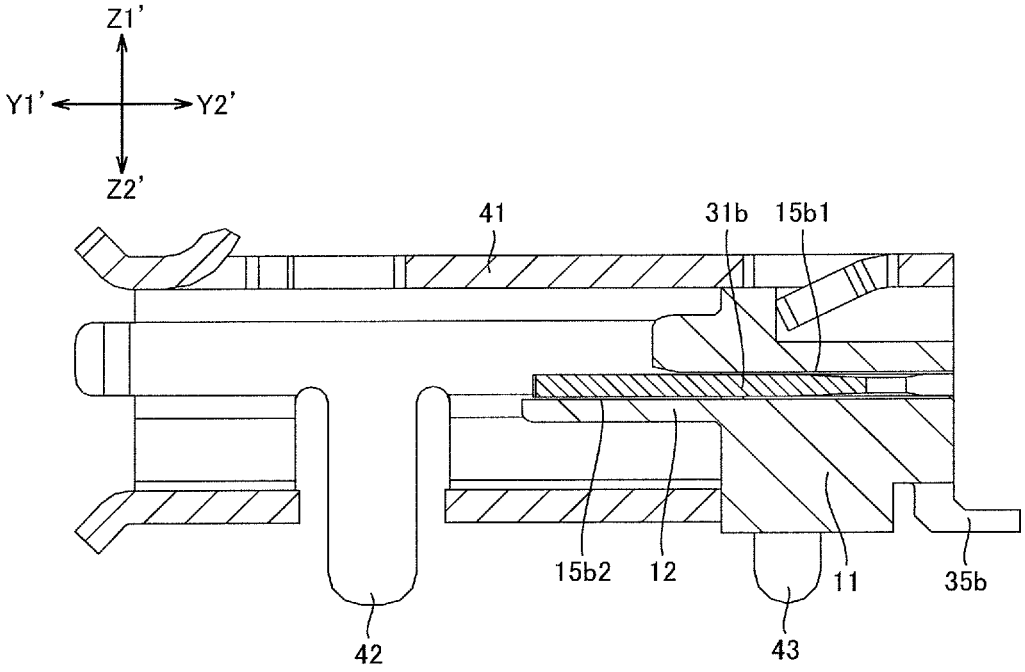
FIG. 9C is a sectional view of the mating connector taken along 9C-9C in FIG. 8A.

The second power terminal 30*b* is a positive (Vcc) power terminal as shown in FIG. 9C and FIG. 12A to FIG. 12B. The second power terminal 30*b* is formed of a metal plate. The second power terminal 30*b* includes a second arm 31*b*, a second contact portion 32*b*, a second L-shaped portion 33*b*, a second engaging portion 34*b*, and a second tail portion 35*b*. The second arm 31*b* is a metal plate extending in the Y1'-Y2' direction. The second arm 31*b* is received in the housing portion body 15*b*2 of the housing portion 15*b*. The second contact portion 32*b* is a protrusion protruding in the X1' direction at the Y1'-direction end of the second arm 31*b*. The second contact portion 32*b* protrudes in the X1' direction out of the housing portion body 15*b*2 of the housing portion 15*b*. As described above, the first and second contact portions 32*a* and 32*b* are exposed from different places (from the housing portion bodies 15*a*2 and 15*b*2, respectively) of the first protruding part 12. The second L-shaped portion 33*b* consists of a horizontal portion and a hanging portion. The horizontal portion is a metal plate extending in the X1' direction from the Y2'-direction end of the second arm 31*b*. The horizontal portion is housed in the horizontal groove of the housing groove 15*b*3. The hanging portion is a metal plate extending in the Z2' direction from the X1'-direction end of the horizontal portion. The hanging portion is housed in the vertical groove of the housing groove 15*b*3. The second engaging portion 34*b* is a metal plate extending in the Y1' direction from the Z2'-direction end of the vertical portion of the second L-shaped portion 33*b*. The second engaging portion 34*b* is received in and engaged with the engaging hole 15*b*1 of the housing portion 15*b*. The second tail portion 35*b* is a metal plate extending in the Y2' direction from the Z2'-direction end of the vertical portion of the second L-shaped portion 33*b*.

The fourth power terminal 30*d* is a negative (GND) power terminal as shown in FIG. 12A to FIG. 12B. The fourth power terminal 30*d* is formed of a metal plate. Since the fourth power terminal 30*d* is symmetric to the second power terminal 30*b*, only the differences between them will be described. A fourth arm 31*d* of the fourth power terminal 30*d* is received in the housing portion body 15*d*2 of the housing portion 15*d*. A fourth contact portion 32*d* of the fourth power terminal 30*d* protrudes in the X2' direction out of the housing portion body 15*d*2 of the housing portion 15*d*. As described above, the third and fourth contact portions 32*c* and 32*d* are exposed at the different places (from the housing portion bodies 15*c*2 and 15*d*2, respectively) of the first protruding part 12. A horizontal portion of a fourth L-shaped portion 33*d* of the fourth power terminal 30*d* is a metal plate extending in the X2' direction from the Y2'-direction end of the second arm 31*b*. The horizontal portion is housed in the horizontal groove of the housing groove 15*d*3. A hanging portion of the fourth L-shaped portion 33*d* of the fourth power terminal 30*d* is a metal plate extending in the Z2' direction from the X2'-direction end of the horizontal portion. The hanging portion is housed in the vertical groove of the housing groove 15*d*3. A fourth engaging portion 34*d* of the fourth power terminal 30*d* is received in and engaged with the engaging hole 15*d*1 of the housing portion 15*d*. The fourth power terminal 30*d* also includes a tail portion 35*d* as illustrated in FIG. 10A to FIG. 10B and FIG. 12A to FIG. 12B.

As illustrated, the first to fourth tail portions 35*a* to 35*d* and the tail portions 24*a* to 24*e* are aligned at intervals along the X1'-X2' direction such that their lower surfaces are flush with each other. The first to fourth tail portions 35*a* to 35*d* and the tail portions 24*a* to 24*e* are connectable to electrodes on a circuit board of electronic equipment equipped with the mating connector R.

As shown in FIG. 8A to FIG. 9C, the shield case 40 is formed of a metal plate. The shield case 40 has a shell 41, a pair of legs 42, and another pair of legs 43. The shell 41 is a metal tube having the inner shape conforming to the outer shape of the tube 510*a* of the shield case 500*a* of the connector P. The shell 41 includes a bottom plate, a top plate, and a pair of side plates. The bottom plate is opposed to the top plate. One of the pair of side plates connects between the X1'-direction end of the bottom plate and the X1'-direction end of the top plate. The other side plate connects between the X2'-direction end of the bottom plate and the X2'-direction end of the top plate in the X2'. The bottom plate is smaller in the Y1'-Y2' direction than the top plate and than each of the side plates. The Y2'-direction end portion of the top plate of the shell 41 and the Y2'-direction end of the side plates of the shell 41 define rear space. The rear space serves to house the base 11 of the body 10, with the base 11 abutting the Y2'-direction end of the bottom plate. The bottom plate, the portion of the top plate excluding the Y2'-direction end portion, and the portions of the side plates excluding the Y2'-direction end portions of the shell 41 define a front space. The front space receives the first and second protruding parts 12 and 13 of the body 10. The front space also receives the contact portions 21*a*, 21*b*, 21*d*, and 21*e* of the signal terminals 20*a* and 20*b*, 20*d*, 20*e* and the contact portion 21*c* of the ground terminal 20*c* protruding out of the second protruding part 13, and the first to fourth contact portions 32*a* to 32*d* of the first to fourth power terminals 30*a* to 30*d* protruding out of the first protruding part 12.

The legs 42 are plates formed by cutting portions in the Y1'-direction side of the bottom plate and the side plates of the shell 41 and extend in the Z2' direction. The legs 43 are plates formed by cutting portions in the Y2'-direction side of the bottom plate and the side plates of the shell 41 and extend in the Z2' direction. The legs 42 and 43 are connectable to through-hole electrodes in the circuit board of the electronic component.

The mating connector R may be assembled in the following manner. First, the body 10, the signal terminals 20*a*, 20*b*, 20*d*, and 20*e* and the ground terminal 20*c* are prepared. The signal terminals 20*a*, 20*b*, 20*d*, and 20*e*, particularly the contact portions 21*a*, 21*b*, 21*d*, and 21*e* and the engaging portions 22*a*, 22*b*, 22*d*, and 22*e*, are respectively inserted into the engaging holes 14*a*1, 14*b*1, 14*d*1, and 14*e*1 of the body 10 from the Y2' direction. The inserted engaging portions 22*a*, 22*b*, 22*d*, and 22*e* are engaged with the engaging holes 14*a*1, 14*b*1, 14*d*1, and 14*e*1, respectively. Also, the contact portion 21*a*, 21*b*, 21*d*, 21*e* are received in the housing grooves 14*a*2, 14*b*2, 14*d*2, and 14*e*2 of the second protruding part 13 of the body 10, and the contact portions 21*a*, 21*b*, 21*d*, and 21*e* are exposed from the housing grooves 14*a*2, 14*b*2, 14*d*2, and 14*e*2, respectively, in the Z2' direction. The L-shaped portions 23*a* and 23*e* of the signal terminals 20*a* and 20*e* are respectively received in the housing grooves 14*a*3 and 14*e*3 of the body 10, and the hanging portions 23*b* and 23*d* of the signal terminals 20*b* and 20*d* are respectively received in the housing grooves 14*b*3 and 14*d*3 of the body 10.

Similarly, the contact portion 21*c* and the engaging portion 22*c* of the ground terminal 20*c* are inserted into the engaging hole 14*c*1 of the body 10 from the Y2' direction. The inserted engaging portion 22*c* is engaged with the engaging hole 14*c*1. Also, the contact portion 21*c* is received in the housing groove 14*c*2 of the second protruding part 13 of the body 10, and the contact portion 21*c* is exposed from the housing groove 14*c*3 in the Z2' direction. The hanging portion 23*c* of the ground terminal 20*c* is received in the housing groove 14*c*3 of the body 10. The ground terminal 20*c* is thus disposed between the signal terminal 20*b* and the signal terminal 20*d*.

The first to fourth power terminals 30*a* to 30*d* are also prepared. The first to fourth power terminals 30*a* to 30*d*, particularly the first to fourth contact portions 32*a* to 32*d* and the first to fourth arms 31*a* to 31*d*, are respectively inserted into the housing portion body 15*a*2 to 15*d*2 of the body 10. Simultaneously, the first to fourth engaging portions 34*a* to 34*d* of the first to fourth power terminals 30*a* to 30*d* are respectively engaged with the engaging hole 15*a*1 to 15*d*1 of the body 10. Then, the first and third contact portions 32*a* and 32*c* protrude in the Z2' direction from the housing portion bodies 15*a*2 and 15*c*2 (the Z2'-direction end face of the first protruding part 12). The second contact portion 32*b* protrudes in the X1' direction from the housing portion body 15*b*2 (the X1'-direction end face of the first protruding part 12). The fourth contact portion 32*d* protrudes in the X2' direction from the housing portion body 15*d*2 (the X2'-direction end face of the first protruding part 12). The first and third hanging portions 33*a* and 33*c* of the first and third power terminals 30*a* and 30*c* are housed in the housing grooves 15*a*3 and 15*c*3 of the body 10. The second and fourth L-shaped portions 33*b* and 33*d* of the second and fourth power terminals 30*b* and 30*d* are respectively housed in the housing grooves 15*b*3 and 15*d*3 of the body 10. As a result, the first hanging portion 33*a* is disposed between the L-shaped portion 23*a* and the hanging portion 23*b*, and the first tail portion 35*a* is disposed between the tail portion 24*a* and the tail portion 24*b*. The third hanging portion 33*c* is disposed between the L-shaped portion 23*e* and the hanging portion 23*d*, and the third tail portion 35*c* is disposed between the tail portion 24*e* and the tail portion 24*d*. The first to fourth tail portions 35*a* to 35*d* and the tail portions 24*a* to 24*e* are aligned at intervals in the X1'-X2' direction such that their lower surfaces are flush with each other The shield case 40 is also prepared. Into the front space of the shell 41 of the shield case 40 inserted are the first and second protruding parts 12 and 13 of the body 10 to house the base 11 of the body 10 in the rear space of the shell 41. The base 11 then abuts on the shell 41. This is how the mating connector R may be assembled.

The assembled mating connector R may be connected to the connector P in the following manner. The tube 510*a* and the protruding part 120 of the connector P are fitted into the front space of the shell 41 of the mating connector R. On the other hand, the first and second protruding parts 12 and 13 of the mating connector R are fitted into the connection hole of the connector P. Then, the first contact portion 32*a* of the first power terminal 30*a* of the mating connector R elastically contacts the third contact portion 210*c* of the third terminal 200*c* of the connector P. The second contact portion 32*b* of the second power terminal 30*b* of the mating connector R elastically contacts the fourth contact portion 210*d* of the fourth terminal 200*d* of the connector P. The third contact portion 32*c* of the third power terminal 30*c* of the mating connector R elastically contacts the first contact portion 210*a* of the first terminal 200*a* of the connector P. The fourth contact portion 32*d* of the fourth power terminal 30*d* of the mating connector R elastically contacts the second contact portion 210*b* of the second terminal 200*b* of the connector P. The claws 321 of the lock pieces 300 of the connector P are engaged with engaging holes in the top plate of the shell 41.

The mating connector R has at least the following technical features. First, the mating connector R realizes power supply to electronic equipment through two electrical systems by way of the first and second power terminals 30*a* and 30*b* and the third and fourth power terminals 30*c* and 30*d*.

Second, he mating connector R has improved connection reliability for the reasons below. The first and second contact portions 32*a* and 32*b* of the first and second power terminals 30*a* and 30*b* are exposed from different places of the first protruding part 12, and the third and fourth contact portions 32*c* and 32*d* of the third and fourth power terminals 30*c* and 30*d* are exposed from different places of the first protruding part 12. In this arrangement, even if the connector P as fitting in the front space of the connector P is pried, it is still possible to maintain the electrical connection of at least one of the first and second contact portions 32*a* and 32*b* to at least one of the third and fourth contact portions 210*c* and 210*d* of the third and fourth terminals 200*c* and 200*d* of the connector P, and the electrical connection of at least one of the third and fourth contact portions 32*c* and 32*d* to at least one of the first and second contact portions 210*a* and 210*b* of the first and second terminals 200*a* and 200*b* of the connector P.

Third, the mating connector R is connectable to a different type of plug connector with contacts that are contactable with the contact portions 21*a* and 21*b* of the signal terminals 20*a* and 20*b*, the contact portion 21*c* of the ground terminal 20*e*, and the contact portions 21*d* and 21*e* of the signal terminals 20*d* and 20*e* but not contactable with the first to fourth power terminals 30*a* to 30*d*. This is made possible by the arrangement of contacts of the mating connector R. Particularly, the contact portions 21*a* and 21*b* of the signal terminals 20*a* and 20*b*, the contact portion 21*c* of the ground terminal 20*c*, and the contact portions 21*d* and 21*e* of the signal terminals 20*d* and 20*e* are exposed from the surface on the Z2'-direction side of the second protruding part 13. The first and third contact portions 32*a* and 32*c* of the first and third power terminals 30*a* and 30*c* protrude in the Z2' direction from the Z2'-direction end face of the first protruding part 12. The second and fourth contact portions 32*b* and 32*d* of the second and fourth power terminals 30*b* and 30*d* protrude from the X1'- and X2'-direction end faces of the first protruding part 12.

The connector P and the mating connector R are not limited to the configurations of the above-mentioned embodiment, but they may be modified in any manner within the scope of the Claims. Specific modifications will be described below in detail.

The first terminal of the connector of the above embodiment includes the first contact portion, the first engaging portion, the first bent portion, and the first connecting portion. However, the first terminal of the connector of the invention may be any contact including the first contact portion and the first connecting portion. For example, the first terminal may include the first contact portion, the first engaging portion, and the first connecting portion.

The third terminal of the connector of the above embodiment includes the third contact portion, the third engaging portion, the third bent portion, and the third connecting portion. However, the third terminal of the connector of the invention may be any contact including the third contact portion and the third connecting portion. For example, the third terminal may include the third contact portion, the third engaging portion, and the third connecting portion.

The second terminal of the connector of the above embodiment includes the second contact portion, the second engaging portion, the second extended portion, and the second connecting portion. However, the second terminal of the connector of the invention may any contact including the second contact portion and the second connecting portion. For example, the second terminal may include the second contact portion, the second engaging portion, and the second connecting portion.

The fourth terminal of the connector of the above embodiment includes the fourth contact portion, the fourth engaging portion, the fourth extended portion, and the fourth connecting portion. However, the fourth terminal of the connector of the invention may be any contact including the fourth contact portion and the fourth connecting portion. For example, the fourth terminal may include the fourth contact portion, the fourth engaging portion, and the fourth connecting portion.

The first connecting portion of the first terminal of the connector of the invention may be embedded in the first bottom of the first recess of the body so as to be exposed from the first bottom, may be disposed on the first bottom, or may be disposed above the first bottom with a clearance therebetween. Alternatively, the first connecting portion may be disposed on top of and in contact with the second portion of the second connecting portion of the second terminal.

The third connecting portion of the third terminal of the connector of the invention may be embedded in the second bottom of the second recess of the body so as to be exposed from the second bottom, may be disposed on the second bottom, or may be disposed above the second bottom with a clearance therebetween. Alternatively, the third connecting portion may be disposed on top of and in contact with the second portion of the fourth connecting portion of the fourth terminal.

The second connecting portion of the second terminal of the connector of the invention may be provided in the first side wall of the first recess of the body so as to be exposed from the first side wall, may be disposed on the first side wall, or may be disposed on the first bottom of the first recess. In the third case, the first connecting portion of the first terminal may be disposed on and in contact with the second connecting portion. The first portion of the second connecting portion of the invention may be provided in the first side wall of the first recess so as to be exposed from the first side wall, or may be disposed on the first side wall of the first recess. The second portion of the second connecting portion of the invention may be contiguous with the first portion of the second connecting portion and disposed under and in contact with the first connecting portion, or may be contiguous with the first portion of the second connecting portion and disposed on and in contact with the first connecting portion. The first and second connecting portions of the invention may be integral with each other.

The fourth connecting portion of the fourth terminal of the connector of the invention may be provided in the second side wall of the second recess of the body so as to be exposed from the second side wall, may be disposed on the second side wall, or may be disposed on the second bottom of the second recess. In the third case, the third connecting portion of the third terminal may be disposed on and in contact with the fourth connecting portion. The first portion of the fourth connecting portion of the invention may be provided in the second side wall of the second recess so as to be exposed from the second side wall, or may be disposed on the second side wall of the second recess. The second portion of the fourth connecting portion of the invention may be contiguous with the first portion of the fourth connecting portion and be disposed under and in contact with the third connecting portion, or may be contiguous with the first portion of the fourth connecting portion and be disposed on and in contact with the third connecting portion. The third and fourth connecting portions of the invention may also be integral with each other.

The first to fourth contact portions of the first to fourth terminals of the connector of the invention may be modified in any manner if provided in the connection part of the body of the connector so as to be connectable with the terminals of the mating connector. For example, the first to fourth contact portions may be embedded in the connecting portions or housed in recesses, grooves, or holes in the connecting portions, so as to be exposed or protruded from the same face or different faces of the connecting portion. The first and second contact portions of the first and second terminals may be exposed from the same face of the connection part of the body. The third and fourth contact portions of the third and fourth terminals may be modified to be exposed from the same face of the connection part of the body.

The first connecting portion 240*a* of the connector P of the above embodiment has smaller outer dimensions than the second portion 242*b* of the second connecting portion 240*b* because of the first and second cut-outs provided in the first connecting portion 240*a*. However, the first connecting portion of the invention smaller outer dimensions than the second portion of the second connecting portion due to other factors. For example, the first connecting portion may be smaller in the X1-X2 direction and/or Y1-Y2 direction than the second portion of the second connecting portion. The outer dimensions of the first connecting portion of the invention may be substantially equal to or larger than those of the second portion of the second connecting portion. If the first connecting portion is disposed below the second connecting portion or the second portion of the second connecting portion, the outer dimensions of the second connecting portion or the second portion of the second connecting portion may be substantially equal to, smaller than, or larger than those of the first connecting portion. The second connecting portion or the second portion of the second connecting portion may have smaller outer dimensions than the first connecting portion due to any factor described above. The outer dimensions of the third and fourth connecting portions may be also modified in a similar manner as in the first and second connecting portions.

The first to fourth terminals of the above embodiment are power terminals. The first to fourth terminals of the invention are not limited to power terminals. In the embodiment, the first and second terminals are positive (Vcc) terminals, and the third and fourth terminals are negative (GND) terminals. Alternatively, the first and second terminals of the invention may be negative (GND) terminals, and the third and fourth terminals of the invention may be positive (Vcc) terminals.

The body of the connector of the invention may be modified in any manner as long as it includes the connection part and the first and second recesses, the first recess has the first bottom and the first side wall, and the second recess has the second bottom and the second side wall. The first side wall of the invention may be a side wall of the first recess on the closer side to the center of the connector, and/or may be inclined with respect to the first bottom. The second side wall of the invention may be a side wall of the second recess on the closer side to the center of the connector, and/or may be inclined with respect to the second bottom. The body of the connector of the invention may have any configuration adapted to hold the first, second, third, and fourth terminals of the embodiment and the modified examples described above. For example, the body of the connector may have the first, second, third, and fourth terminals of the embodiment or any of the modified examples embedded therein by insert molding or other means.

The connection part of the body of the connector of the above embodiment is a recess adapted to fittingly receive the first and second protruding parts of the mating connector. However, the connection part of the invention may be modified in any manner if connectable to the mating connector. For example, the connection part may be modified to be a convex part to fit in the mating connector.

The first and second core wires of the cable of the above embodiment are the first and second connection objects. However, the first connection object of the invention may be modified in any manner if connectable in the first recess to the first and second connecting portions of the embodiment or any of the modified examples described above. The second connection object of the invention may be modified in any manner if connectable in the second recess to the third and fourth connecting portions of the embodiment or any of the modified examples described above. For example, the first and second connection objects may be terminals, pins, or protrusions of a circuit board. In any of these cases, the connector of the invention may be modified to a receptacle connector. The shield cases 500*a* and 500*b*, the case 600, and/or the insulating tape 700 may be omitted. The first connection object may be connected to the first and second connecting portions of the invention by soldering, or by welding or physical contact. Similarly, the second connection object may be connected to the third and fourth connecting portions of the invention by soldering, or by welding or physical contact.

The mating connector of the invention may be modified in any manner as long as it includes the body having an insulation property and the pair of power terminals held by the body, one of the power terminals is contactable with one of the first and second contact portions of the first and second terminals according to any of the above-mentioned aspects, and the other power terminal is contactable with one of the third and fourth contact portions of the third and fourth terminals according to any of the above-mentioned aspects. In other words, it is possible to omit one of the first and second power terminals and one of the third and fourth power terminals. The power terminals may each have a contact portion partially exposed from the first protruding part of the body of the mating connector, and the signal terminals may each have a contact portion partially exposed from the second protruding part of the body of the mating connector. The power terminals and the signal terminals may be exposed or protruded from the same place (for example, the base or the first protruding part) of the body of the mating connector.

The mating connector of the invention may be modified to include a body having an insulation property, a first power terminal held by the body and contactable with the third contact portion of the third terminal, a second power terminal held by the body and contactable with the fourth contact portion of the fourth terminal, a third power terminal held by the body and contactable with the first contact portion of the first terminal, and a fourth power terminal held by the body and contactable with the second contact portion of the second terminal. That is, the signal terminal can be omitted. Alternatively, the mating connector of the invention may include at least one signal terminal. The signal terminal(s) and the first to fourth power terminals of the mating connector of the invention may have contact portions exposed or protruded from the same place (the base or the first protruding part) of the body. Also, the mating connector of the invention may be modified to a plug connector, by connecting the signal terminal(s) or the first to fourth power terminals used as the signal terminals to a cable. The signal terminal(s) of the mating connector of the invention may be used as a terminal or terminals for transmitting single ended signals.

It should be appreciated that the embodiments and modifications are described above by way of examples only. The materials, shapes, dimensions, numbers, arrangements, and other configurations of the constituents of the connector and the mating connector may be modified in any manner if they can perform similar functions. The configurations of the embodiment and the modified examples described above may be combined in any possible manner.

REFERENCE SIGNS LIST

P: Connector
100: Body
110: Base
120: Protruding part
130*a*: First recess
131*a*: First bottom
132*a*: First side wall
130*b*: Second recess
131*b*: Second bottom
132*b*: Second side wall
140: Connecting portion
150*a*: Housing portion
150*b*: Housing portion
150*c*: Housing portion
150*d*: Housing portion
160: Housing portion
200*a*: First terminal
210*a*: First contact portion
220*a*: First engaging portion
230*a*: First bent portion
240*a*: First connecting portion
200*b*: Second terminal
210*b*: Second contact portion
220*b*: Second engaging portion
230*b*: Second extended portion
240*b*: Second connecting portion
241*b*: First portion
242*b*: Second portion
200*c*: Third terminal

210*c*: Third contact portion
220*c*: Third engaging portion
230*c*: Third bent portion
240*c*: Third connecting portion
200*d*: Fourth terminal
210*d*: Fourth contact portion
220*d*: Fourth engaging portion
230*d*: Fourth extended portion
240*d*: Fourth connecting portion
241*d*: First portion
242*d*: Second portion
300: Lock piece
400: Cable
410*a*: First core wire (first connection object)
410*b*: Second core wire (second connection object)
420: Insulator
500*a*: Shield case
500*b*: Shield case
600: Case
700: Blocking plate
R: Mating connector
10: Body
20*a*: Signal terminal
20*b*: Signal terminal
20*c*: Ground terminal
20*d*: Signal terminal
20*e*: Signal terminal
30*a*: First power terminal
30*b*: Second power terminal
30*c*: Third power terminal
30*d*: Fourth power terminal
40: Shield case

The invention claimed is:

1. A connector comprising:

a body having an insulation property, the body including:
a connection part;
a first recess including a first bottom and a first side wall; and
a second recess including a second bottom and a second side wall;

first, second, third, and fourth terminals held by the body,
the first terminal including:
a first contact portion provided at the connection part of the body, and
a first connecting portion, provided in the first bottom of the body so as to be exposed from the first bottom, or provided on the first bottom, or provided with clearance from the first bottom,
the second terminal including:
a second contact portion provided at the connection part of the body, and
a second connecting portion, provided in the first side wall of the body so as to be exposed from the first side wall, or provided on the first side wall,
the third terminal including:
a third contact portion provided at the connection part of the body, and
a third connecting portion, provided in the second bottom of the body so as to be exposed from the second bottom, or provided on the second bottom, or provided with clearance from the second bottom,
the fourth terminal including:
a fourth contact portion provided at the connection part of the body, and
a fourth connecting portion, provided in the second side wall of the body so as to be exposed from the second side wall, or provided on the second side wall, and
first and second connection objects, the first connection object being connected to the first and second connecting portions in the first recess, the second connection object being connected to the third and fourth connecting portions in the second recess.

2. The connector according to claim 1, wherein the second connecting portion includes:
a first portion, provided in the first side wall of the body so as to be exposed from the first side wall, or provided on the first side wall; and
a second portion contiguous with the first portion, the second portion being located under and in contact with the first connecting portion, and
the fourth connecting portion includes:
a first portion, provided in the second side wall of the body so as to be exposed from the second side wall, or provided on the second side wall; and
a second portion contiguous with the first portion of the fourth connecting portion, the second portion of the fourth connecting portion being located under and in contact with the third connecting portion.

3. The connector according to claim 2, wherein the first connecting portion has smaller outer dimensions than the second portion of the second connecting portion, and
the third connecting portion has smaller outer dimensions than the second portion of the fourth connecting portion.

4. The connector according to claim 1, wherein the second connecting portion includes:
a first portion, provided in the first side wall of the body so as to be exposed from the first side wall, or provided on the first side wall; and
a second portion contiguous with the first portion, the second portion being located on top of and in contact with the first connecting portion, and
the fourth connecting portion includes:
a first portion, provided in the second side wall of the body so as to be exposed from the second side wall, or provided on the second side wall; and
a second portion contiguous with the first portion of the fourth connecting portion, the second portion of the fourth connecting portion being located on top of and in contact with the third connecting portion.

5. The connector according to claim 4, wherein the second portion of the second connecting portion has smaller outer dimensions than the first connecting portion, and
the second portion of the fourth connecting portion has smaller outer dimensions than the third connecting portion.

6. A connector comprising:

a body having an insulation property, the body includes:
a connection part,
a first recess including a first bottom and a first side wall, and
a second recess including a second bottom and a second side wall, first, second, third, and fourth terminals held by the body, the second terminal including:
a second contact portion provided at the connection part of the body, and
a second connecting portion provided on the first bottom of the body,
the first terminal including:
a first contact portion provided at the connection part of the body, and
a first connecting portion provided on the second connecting portion, the fourth terminal including:

a fourth contact portion provided at the connection part of the body, and a fourth connecting portion provided on the second bottom of the body, the third terminal including:

a third contact portion provided at the connection part of the body, and a third connecting portion provided on the fourth connecting portion; and first and second connection objects, the first connection object being connected to the first and second connecting portions in the first recess, the second connection object being connected to the third and fourth connecting portions in the second recess.

7. The connector according to claim 1, wherein the first and second connecting portions are integral with each other, and the third and fourth connecting portions are integral with each other.

8. The connector according to claim 6, wherein the first and second connecting portions are integral with each other, and the third and fourth connecting portions are integral with each other.

9. The connector according to claim 1, further comprising a cable, the cable including:

a first core wire serving as the first connection object, and a second core wire serving as the second connection object.

10. The connector according to claim 6, further comprising a cable, the cable including:

a first core wire serving as the first connection object, and a second core wire serving as the second connection object.

11. The connector according to claim 1, wherein the first and second contact portions are provided at the connection part so as to be at least partially exposed from different places of the connection part, and the third and fourth contact portions are provided at the connection part so as to be at least partially exposed from different places of the connection part.

12. The connector according to claim 6, wherein the first and second contact portions are provided at the connection part so as to be at least partially exposed from different places of the connection part, and the third and fourth contact portions are provided at the connection part so as to be at least partially exposed from different places of the connection part.

13. A mating connector connectable to the connector according to claim 1, the mating connector comprising:

a body having an insulation property;

a signal terminal held by the body of the mating connector;

a first power terminal held by the body of the mating connector so as to be contactable with the third contact portion of the third terminal;

a second power terminal held by the body of the mating connector so as to be contactable with the fourth contact portion of the fourth terminal;

a third power terminal held by the body of the mating connector so as to be contactable with the first contact portion of the first terminal; and a fourth power terminal held by the body of the mating connector so as to be contactable with the second contact portion of the second terminal.

14. A mating connector connectable to the connector according to claim 6, the mating connector comprising:

a body having an insulation property;

a signal terminal held by the body of the mating connector;

a first power terminal held by the body of the mating connector so as to be contactable with the third contact portion of the third terminal;

a second power terminal held by the body of the mating connector so as to be contactable with the fourth contact portion of the fourth terminal;

a third power terminal held by the body of the mating connector so as to be contactable with the first contact portion of the first terminal; and a fourth power terminal held by the body of the mating connector so as to be contactable with the second contact portion of the second terminal.

15. The mating connector according to claim 13, wherein the body of the mating connector includes:

a base;

a first protruding part provided on the base; and a second protruding part provided on the first protruding part, the first, second, third, and fourth power terminals include first, second, third, and fourth contact portions, respectively, partially exposed from the first protruding part, and the signal terminal includes a contact portion partially exposed from the second protruding part.

16. The mating connector according to claim 14, wherein the body of the mating connector includes:

a base;

a first protruding part provided on the base; and a second protruding part provided on the first protruding part, the first, second, third, and fourth power terminals include first, second, third, and fourth contact portions, respectively, partially exposed from the first protruding part, and the signal terminal includes a contact portion partially exposed from the second protruding part.

17. The mating connector according to claim 15, wherein the exposed parts of the first and second contact portions are exposed from different places of the first protruding part, and the exposed parts of the third and fourth contact portions are exposed at different places of the first protruding part.

18. The mating connector according to claim 16, wherein the exposed parts of the first and second contact portions are exposed from different places of the first protruding part, and the exposed parts of the third and fourth contact portions are exposed at different places of the first protruding part.

19. A mating connector connectable to the connector according to claim 1, wherein the mating connector comprising:

a body having an insulation property;

a signal terminal held by the body of the mating connector; and a pair of power terminals held by the body of the mating connector, one of the power terminals being contactable with one of the first and second contact portions of the first and second terminals, and the other power terminal being contactable with one of the third and fourth contact portions of the third and fourth terminals.

20. A mating connector connectable to the connector according to claim 6, wherein the mating connector comprising:

a body having an insulation property;

a signal terminal held by the body of the mating connector; and a pair of power terminals held by the body of the mating connector, one of the power terminals being contactable with one of the first and second contact portions of the first and second terminals, and the other power terminal being contactable with one of the third and fourth contact portions of the third and fourth terminals.

21. The mating connector according to claim 19, wherein the body of the mating connector includes:

a base;

a first protruding part provided on the base;

a second protruding part provided on the first protruding part;

the power terminals each include a contact portion partially exposed from the first protruding part, and the signal terminal include a contact portion partially exposed from the second protruding part.

22. The mating connector according to claim 20, wherein the body of the mating connector includes:

a base;

a first protruding part provided on the base;

a second protruding part provided on the first protruding part;

the power terminals each include a contact portion partially exposed from the first protruding part, and the signal terminal include a contact portion partially exposed from the second protruding part.

* * * * *